US006923037B2

(12) United States Patent
Bowles et al.

(10) Patent No.: US 6,923,037 B2
(45) Date of Patent: Aug. 2, 2005

(54) ASSEMBLY FOR ARTICULATING CRIMP RING AND ACTUATOR

(75) Inventors: Richard R. Bowles, Solon, OH (US); James E. Hamm, Grafton, OH (US); Paul W. Gress, Bay Village, OH (US)

(73) Assignee: Emerson Electric Co., St. Louis, MO (US)

( * ) Notice: Subject to any disclaimer, the term of this patent is extended or adjusted under 35 U.S.C. 154(b) by 56 days.

(21) Appl. No.: 10/462,873

(22) Filed: Jun. 16, 2003

(65) Prior Publication Data

US 2003/0230130 A1 Dec. 18, 2003

Related U.S. Application Data

(60) Provisional application No. 60/389,218, filed on Jun. 17, 2002.

(51) Int. Cl.[7] ..... B21D 39/04

(52) U.S. Cl. ..... 72/416; 72/402; 29/237

(58) Field of Search ..... 72/292, 402, 416, 72/450, 481.1, 482.92, 409.19; 29/282, 237, 283.5

(56) References Cited

U.S. PATENT DOCUMENTS

| | | | | | |
|---|---|---|---|---|---|
| 639,277 | A | * | 12/1899 | Pangle | 72/292 |
| 2,739,373 | A | * | 3/1956 | Kane, Jr. | 29/237 |
| 2,871,812 | A | * | 2/1959 | Pederson | 269/153 |
| 3,041,713 | A | * | 7/1962 | Gronlund | 29/256 |
| 3,263,479 | A | * | 8/1966 | Johnson | 72/416 |
| 3,555,875 | A | * | 1/1971 | Clark | 72/292 |
| 3,668,915 | A | * | 6/1972 | Ribback | 72/76 |
| 5,148,698 | A | | 9/1992 | Dischler | 72/410 |
| 5,598,732 | A | | 2/1997 | Dischler | 72/292 |
| 5,619,883 | A | | 4/1997 | Dischler | 72/400 |
| 6,044,681 | A | | 4/2000 | Frenken | 72/292 |
| 6,044,686 | A | | 4/2000 | Dischler | 72/402 |
| 6,058,755 | A | | 5/2000 | Viegener | 72/292 |
| 6,128,975 | A | | 10/2000 | Schley et al. | 81/9.9 |
| 6,405,411 | B1 | | 6/2002 | Allemann et al. | 24/19 |
| 6,477,757 | B2 | | 11/2002 | Viegener | 29/237 |
| 2002/0050041 | A1 | | 5/2002 | Viegener | 29/237 |

FOREIGN PATENT DOCUMENTS

| | | |
|---|---|---|
| DE | 93 14 054 | 1/1994 |
| DE | 19734355 | 8/1999 |

OTHER PUBLICATIONS

International Search Report dated Oct. 23, 2003 for the related pending PCT application PCT/US03/18972, 3–pgs.

* cited by examiner

*Primary Examiner*—Daniel C. Crane
(74) *Attorney, Agent, or Firm*—Locke Liddell & Sapp LLP

(57) ABSTRACT

Assemblies are disclosed for articulating a crimp ring for crimping a fitting relative to an actuator for actuating the crimp ring. The crimp ring includes segments for engaging the fitting, and the actuator includes arms for actuating the segments. Embodiments disclosed include articulating assemblies coupling between the actuator arms and crimp ring segments having multiple axes of articulation. Additional embodiments disclosed include articulating assemblies that are insertable between the arms and segments, articulating assemblies having fixed angled arms of the actuator, articulating assemblies using ball and sockets between the arms and segments, and articulating assemblies used in an intermediate position between the arms and segments.

30 Claims, 17 Drawing Sheets

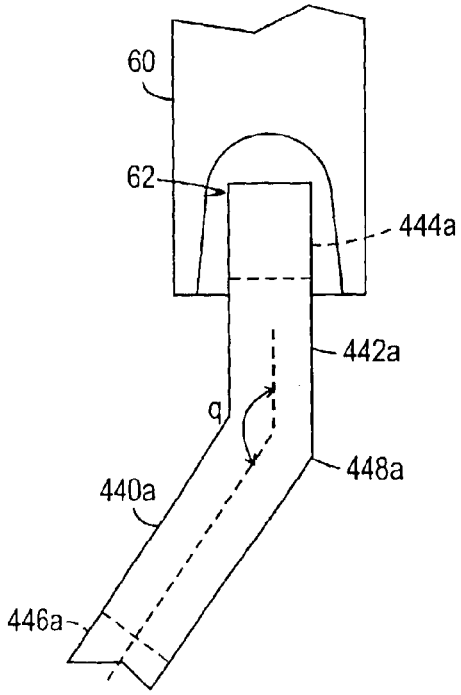
FIG. 15A
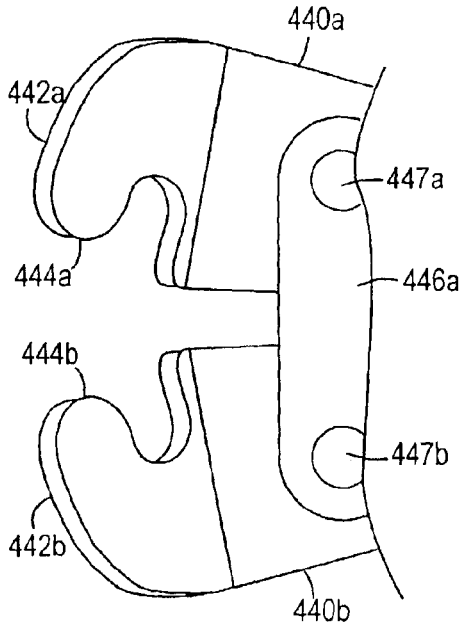
FIG. 15B
FIG. 16
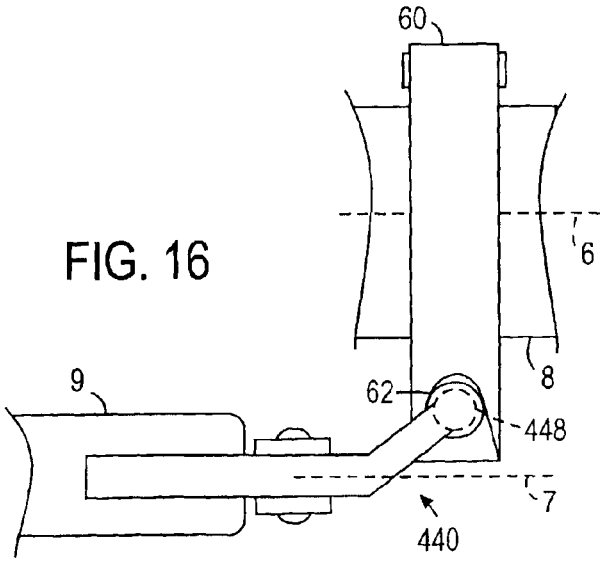

ASSEMBLY FOR ARTICULATING CRIMP RING AND ACTUATOR

CROSS REFERENCE TO RELATED APPLICATIONS

This application claims priority to U.S. Provisional Application Ser. No. 60/389,218, filed Jun. 17, 2002, entitled "Assembly for Articulating Crimp Ring and Actuator," which is incorporated herein by reference in its entirety.

FIELD OF THE INVENTION

The present invention relates generally to crimping tools and, more particularly to an assembly for articulating a crimp ring and an actuator.

BACKGROUND OF THE INVENTION

A compression fitting is typically a tubular sleeve made of plastic or metal and containing seals. To produce a joint between two pipe ends, the fitting is slid over the ends of the pipes and then compressed radially to form a leak resistant joint between the pipe ends. The joint has considerable mechanical strength and is self-supporting. A crimping tool is used to compress the fitting on the pipe ends. A typical crimping tool includes at least two arms or end portions. A drive mechanism, such as a hydraulic piston acted upon by hydraulic pressure from a pump within the tool, is used to move the arms. In some embodiments, at least a portion of the arms may be moved radially inward during the crimping operation to directly crimp the fitting. In other embodiments, the arms may actuate a crimp ring that crimps the fitting. Typically, the crimp ring includes two to seven ring segments connected together. The end portions of the crimping tool couple to pivot ports or indentations defined in opposing crimp ring segments. In general, crimp rings are used to crimp a fitting having a diameter greater than approximately 2.5-inches. Some existing crimp slings are used on diameters as small as 42-mm or 1½", such as the multi-segment crimp slings made by Mapress.

Referring to FIG. 1, a typical, non-articulating actuator arm 2 and crimp ring segment 6 are illustrated in a top view. Actuator arm 2 and crimp ring segment 6 only allow for in-line engagement of the arm with the crimp ring. With in-line engagement, actuator arm 2 is parallel to the plane of crimp ring segment 6 and perpendicular to an axial centerline A of the tube T to be fitted. However, an operator does not always have such access to crimp a fitting. A solution in the art has been to provide an articulating connection between actuator arm 2 and crimp ring segment 6, allowing the operator to access and crimp the fitting at an angle.

Referring to FIGS. 2A–B, a typical method according to the prior art for articulating an actuator arm 2 relative to a crimp ring segment 6 is illustrated. In FIG. 2A, the actuator arm 2 is shown in a top view articulated relative to crimp ring segment 6. In FIG. 2B, a portion of actuator arm 2 engaging a portion of crimp ring segment 6 are shown in cross-section. Actuator arm 2 includes a hemispherical-shaped end 3 and a pivot hole 4. Crimp ring segment 6 defines an indented swivel point 8. To provide the articulating connection, hemispherical-shaped end 3 of arm 2 is disposed in indented swivel point 8. The mating of hemispherical-shaped end 3 with the deep indented swivel point allows arm 2 to articulate relative to ring segment 6, as illustrated by path S in FIG. 2A. This conventional articulating connection enables an operator to actuate crimp ring segment 6 with actuator arm 2 when there is obstructed or limited accessibility.

During a crimp operation, a drive member contacts arm 2 causing it to pivot about a pin (not shown) in pivot hole 4. Hemispherical-shaped end 3 disposed in indented swivel point 8 transfers force and motion of actuator arm 2 to crimp ring segment 6, which is itself typically connected to another segment (not shown) by a pivot pin. Hemispherical-shaped end 3 is able to slide in indented swivel point 8 as arm 2 and crimp ring segment 6 are separately pivoted. Unfortunately, the conventional articulating connection between arm 2 and crimp ring segment 6 provides only a single point of contact or a limited area of contact between the arm 2 and segment 6 during the crimping operation. With such limited contact, the stress on the components, such as arm 2, increases; therefore, it is desirable to have an articulating connection between an arm and a crimp ring segment that provides a greater amount of contact therebetween. Furthermore, the conventional articulating connection may unduly fatigue the arm 2 or crimp ring segment 6 as they are pivoted during the crimping operation. In addition, the conventional articulating connection between the arm 2 and crimp ring segment 6 may require tedious and expensive machining of a cast crimp ring segment 6 to produce a suitable indented swivel point 8 and may similarly require tedious and expensive machining a cast arm 2 to produce a suitable hemispherical-shaped end 3.

Teachings of the present disclosure are directed to overcoming, or at least reducing the effects of, one or more of the problems set forth above.

SUMMARY OF THE DISCLOSURE

Assemblies are disclosed for articulating a crimp ring for crimping a fitting relative to an actuator for actuating the crimp ring. The crimp ring includes segments for engaging the fitting, and the actuator includes arms for actuating the segments. Embodiments disclosed include articulating assemblies coupling between the actuator arms and crimp ring segments having multiple axes of articulation. Additional embodiments disclosed include articulating assemblies that are insertable between the arms and segments, articulating assemblies having fixed angled arms of the actuator, articulating assemblies using ball and sockets between the arms and segments, and articulating assemblies used in an intermediate position between the arms and segments. While allowing for articulating connections between an actuator and a crimp ring, the disclosed articulating assemblies preferably increase the contact area between the actuator arms and the crimp ring segments to reduce detrimental effects on the actuator and crimp ring due to force, contact stress, wear, and fatigue.

In one embodiment, an assembly for articulating the actuator arm and the crimp ring segment includes first and second articulating portions. The first articulating portion of the assembly couples with the arm and defines a first axis of articulation. The second articulating portion of the assembly couples with the first articulating portion and the segment. The second articulating portion articulates relative to the first portion about the first axis of articulation. The second articulating portion defines a second axis of articulation and articulates relative to the segment about the second axis of articulation.

In one embodiment, the first articulating portion includes a first pin and a cam member. The first pin is pivotably attached to the arm by a hinge pin in the arm positioned through a cross-hole in the first pin. The cross-hole is preferably elongated along the axial length of the first pin. The cam member is integrally attached to the first pin or slideably positioned on the first pin. The cam member positions between the arm and the second articulating portion. The cam member defines a curved surface for engaging a curved end of the arm and defines a flat surface for engaging the second articulating portion.

In one embodiment, the second articulating portion includes a second pin rotatably coupled with an axial end of the first articulating portion. The second pin defines a hole having the axial end of the first articulating portion fixedly attached therein, and the second pin fits within a pocket defined in an end of the segment. The second articulating portion defines an at least partially radial surface for engaging the at least partially radial pocket defined in the segment. Alternatively, the second articulating portion includes a second pin rotatably coupled to the crimp ring segment. The second pin defines a hole rotatably and removably coupling with an axial end of the first articulating portion.

In additional embodiments, assemblies for articulating an actuator relative to a crimp ring include a cross member, a first coupling member, and a second coupling member. The first and second coupling members are movably disposed on the cross member. The first coupling member has a first portion engaging a pivot port defined in one of the ring segments and has a second portion engaging one arm of the actuator. The second coupling member has a first portion engaging a pivot port defined in another of the ring segments and has a second portion engaging another arm of the actuator. The arms of the actuator engage the second portions of the first and second coupling members from a plurality of angular orientations.

In other embodiments, various hemispherical shaped or ball ends are disclosed for an arm of a crimp ring actuator. In another embodiment, a bushing is positioned in a pivot port of a crimp ring segment. The bushing defines a hemispherical shaped pocket for receiving a hemispherical end of an actuator arm.

The foregoing summary is not intended to summarize each potential embodiment or every aspect of the present disclosure.

BRIEF DESCRIPTION OF THE DRAWINGS

The foregoing summary, preferred embodiments, and other aspects of the present disclosure will be best understood with reference to the following detailed description when read in conjunction with the accompanying drawings, in which:

FIGS. 15A–B illustrate an embodiment of a fixed angle actuator for actuating a crimp ring at a predetermined degree of articulation.

FIG. 16 illustrates an embodiment of a fixed angle actuator with hemispherical ends for positioning a crimping tool substantially parallel to a tube being fitted.

Figure 1:
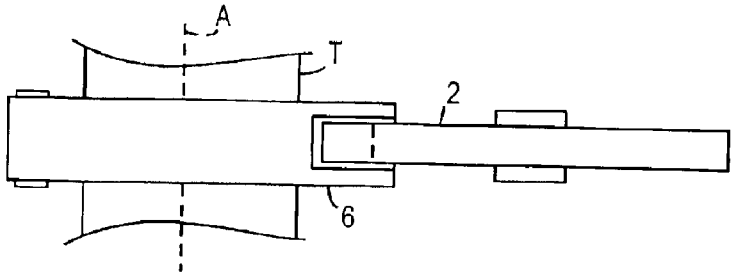
FIG. 1 (Prior Art)
FIG. 1 illustrates a typical, non-articulating assembly of an actuator arm and crimp ring in accordance with the prior art.
Figure 2A:
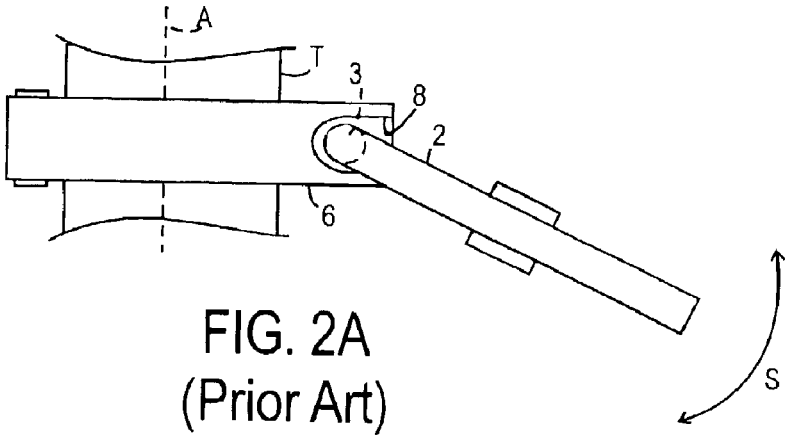
FIG. 2A (Prior Art)
FIGS. 2A–B illustrates a typical assembly for articulating a crimp ring relative to an actuator arm according to the prior art.
Figure 2B:
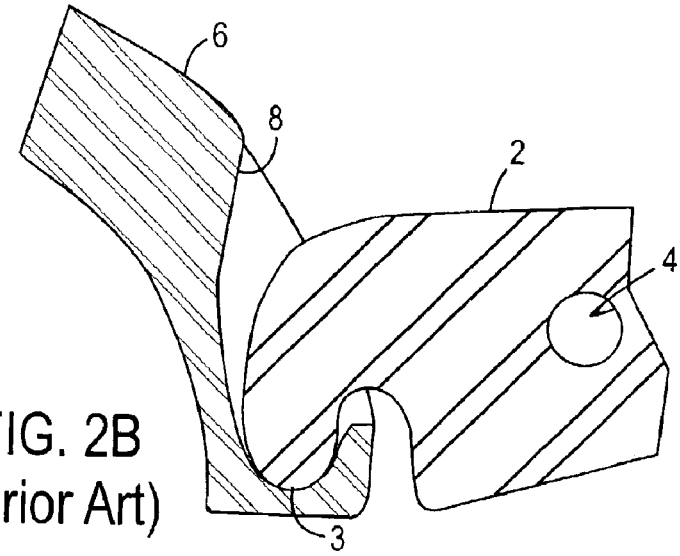
FIG. 2B (Prior Art)

While the subject matter of the present disclosure is susceptible to various modifications and alternative forms, specific embodiments have been shown by way of example in the drawings and are herein described in detail. The figures and written description are not intended to limit the scope of the inventive concepts in any manner. Rather, the figures and written description are provided to illustrate the inventive concepts to any person skilled in the art by reference to particular embodiments, as required by 35 U.S.C. § 112.

DETAILED DESCRIPTION

A. Multiple Points of Articulation

Figure 3B:
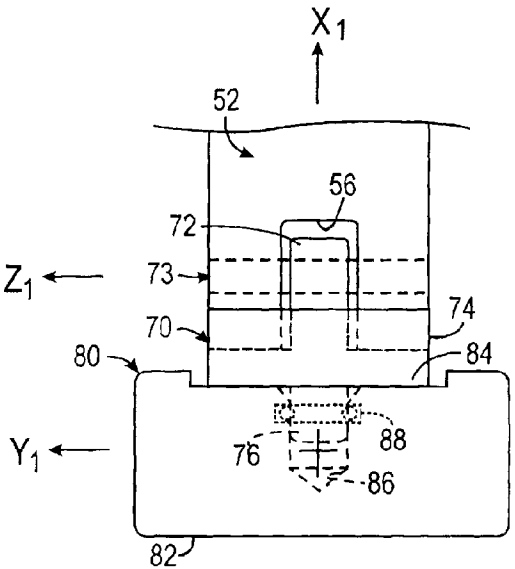
FIGS. 3A–B illustrate an embodiment of an assembly for articulating a crimp ring relative to an actuator arm according to certain teachings of the present disclosure.
Figure 3A:
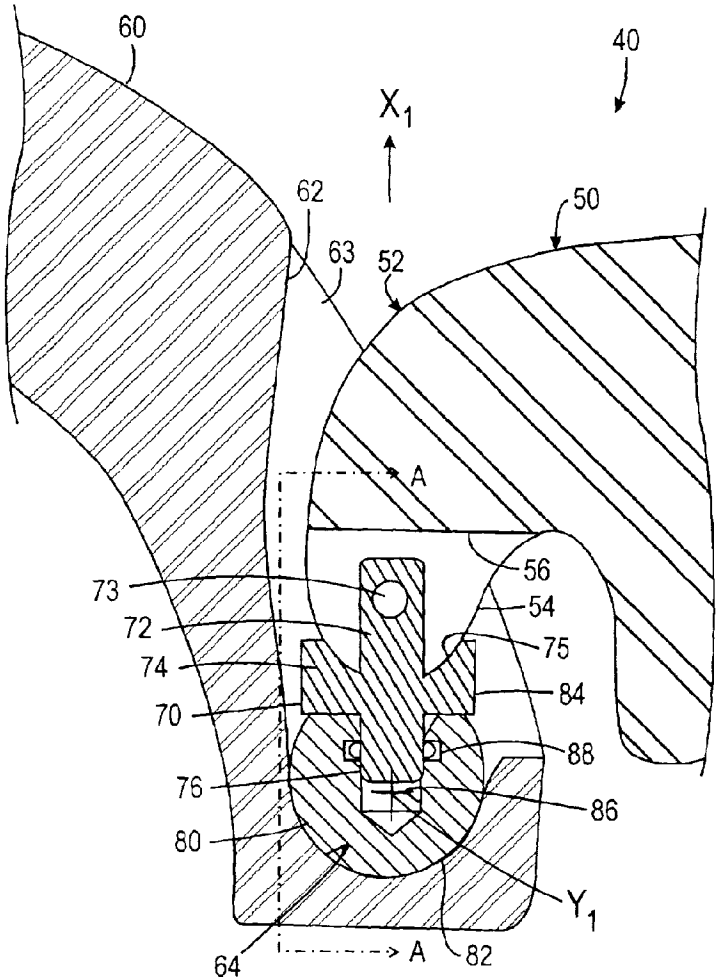

In one embodiment of an assembly for articulating an actuator relative to a crimp ring, an articulating coupling between an arm of the actuator and a segment of the crimp ring is used. Referring to FIGS. 3A–B, an embodiment of an articulating coupling 40 between an actuator arm 50 and a crimp ring segment 60 is illustrated. In FIG. 3A, articulating coupling 40, a portion of arm 50, and a portion of segment 60 are illustrated in side cross-section. For simplicity in FIG. 3A, only one articulating coupling 40 is illustrated between one actuator arm 50 and one crimp ring segment 60. It is understood that a second articulating connection may be similarly formed between a second actuator arm and a second crimp ring segment. In addition, the crimp ring segment is not shown in FIG. 3B for clarity.

Actuator arm 50 includes an end portion 52 having articulating coupling 40 attached thereon and removably disposing in a pivot port 62 defined in segment 60. End portion 52 has a rounded distal end 54 defining a slot 56 therein. Attached to end portion 52, articulating coupling 40 includes a first axial member or articulating portion 70 and a second axial member or articulating portion 80. In FIG. 3B, the pins 70 and 80 are illustrated in a frontal view attached to end portion 52. As best shown in FIG. 3B, second articulating portion 80 has a greater width than end portion 52. Alternatively, second articulating portion 80 and end portion 52 can have substantially the same width.

First articulating portion 70 includes an upper section 72, a middle section 74, and a lower section 76. Upper section 72 is an axial pin or end disposed in slot 56 and connected to end portion 52 by a hinge pin 73 positioned through a cross hole in upper section 72. As best shown in FIG. 3A, middle section 74 is a cam member integrally connected to upper section 72. Middle section or cam member 74 has a curved, top surface 75 for engaging the curved end 54 of end portion 52 and has a flat, bottom surface for engaging the second articulating portion 80. Hinge pin 73 is used primarily to hold first articulating portion 70 on arm 50 and is not intended to sustain any substantial load during a crimping operation. Therefore, the cross–hole in upper section 72 may be larger than hinge pin 73 to allow middle section 74 to contact curved end 54 without placing load on hinge pin 73.

Lower section 76 is an axial pin or end integrally connected to middle section 74. Lower section 76 extends from middle section 74 and is disposed in a cross-hole 86 defined in second articulating portion 80. A retainer or spring clip 88 is used to keep first and second articulating pins 70 and 80 attached to one another, yet allow for rotation of second portion 80 on lower section 76 of first portion 70. Second articulating portion 80 has an at least partially radial surface 82 and has a flat portion 84 adjacent middle section 74. Cross-hole 86 may be drilled partially into a side of second portion 80, and flat portion 84 may be milled on the outside surface of second portion 80 perpendicular to cross-hole 86. As best shown in FIG. 3B, the second portion 80 is preferably similar to a pin oriented perpendicularly to the first portion 70 and having a length substantially greater than the width of the first portion 70. Thus, the at least partially radial surface 82 of second portion 70 is preferably an at least partially cylindrical surface like that of a pin or cylinder as opposed to that of a sphere. Providing second portion 80 with an at least partially cylindrical surface provides more support for coupling 40 and better contact area.

The engagement of curved, top surface 75 with curved end 54 allows middle section 74 to slide against end 54 and maintain substantial contact therewith to increase the contact area between first articulating portion 70 and arm 50. In addition, the engagement of the flat, bottom surface of middle section 74 with flat portion 84 of second articulating portion 80 increases the contact area between articulating pins 70 and 80. Furthermore, the partial cylindrical surface of second portion 80 makes substantial contact with a bottom surface 64 of pivot port 62 (FIG. 3A). These increased areas of contact reduce detrimental effects on arm 50 and ring segment 60 due to force, contact stress, wear, and fatigue.

To form articulating coupling 40, second articulating portion 80 connected on end portion 52 is positioned into pivot port 62 of ring segment 60. Pivot port 62 may further define guiding sidewalls 63, one of which is shown in FIG. 3A, to facilitate the positioning of end portion 52 in port 62. The partial cylindrical surface of second articulating portion 80 engages rounded bottom 64 of pivot port 62.

Once coupled, actuator arm 50 and ring segment 60 can articulate relative to one another about a first axis $X_1$ provided by lower section 76 being rotatable within cross-hole 86. With the articulation of arm 50 about first axis $X_1$, an operator can angle arm 50 relative to ring segment 60 when perpendicular access to the fitting is restricted. For example, articulating coupling 40 according to the present embodiment may allow the operator to actuate arm 50 at a dihedral angle of approximately ±45-degrees from its aligned plane with ring segment 60.

As best shown in FIG. 3B, actuator arm 50 and ring segment 60 can also articulate relative to one another about a second axis $Y_1$ provided by second portion 80 being rotatable within rounded bottom 64 of pivot port 62. Second axis $Y_1$ is substantially perpendicular to first axis $X_1$. The articulation of arm 50 about second axis $Y_1$ relative to ring segment 60 accommodates for movement of arm 50 and segment 60 due to their separate points of pivot. Specifically, arm 50 pivots about a pivot point of an actuator assembly (not shown), while ring segment 60 pivots about a pivot pin (not shown) hingedly connecting segment 60 with another segment.

In addition, actuator arm 50 is able to articulate about a third axis $Z_1$ relative to articulating coupling 40 provided by the engagement between curved surface 75 and curved end 54. Third axis $Z_1$ of articulation enables the pivoting motion of the arm to be substantially transferred to a plane substantially parallel to the second axis $Y_1$ of articulation. Third axis $Z_1$ is also substantially perpendicular to first axis $X_1$. The additional degree of freedom provided by third axis $Z_1$ helps prevent binding between second portion 80 and surface 64 of port 62 as actuator arm 50 and segment 60 are pivoted during a crimping operation.

It is understood that a reverse assembly of articulated coupling 40 discussed above can also be used for articulating an actuator arm relative to a ring segment. In such a reversed embodiment, the ring segment can include a first articulating pin hingedly attached thereto so that the segment articulates about an axis, such as second axis $Y_1$. A second articulating pin can be coupled to the first articulating pin and can be rotatable thereon about another axis, such as the first axis $X_1$. The end portion of the actuator arm can define a receiver for engaging the second articulating pin and being rotatable thereon about another axis, such as the third axis $Z_1$.

Figure 4B:
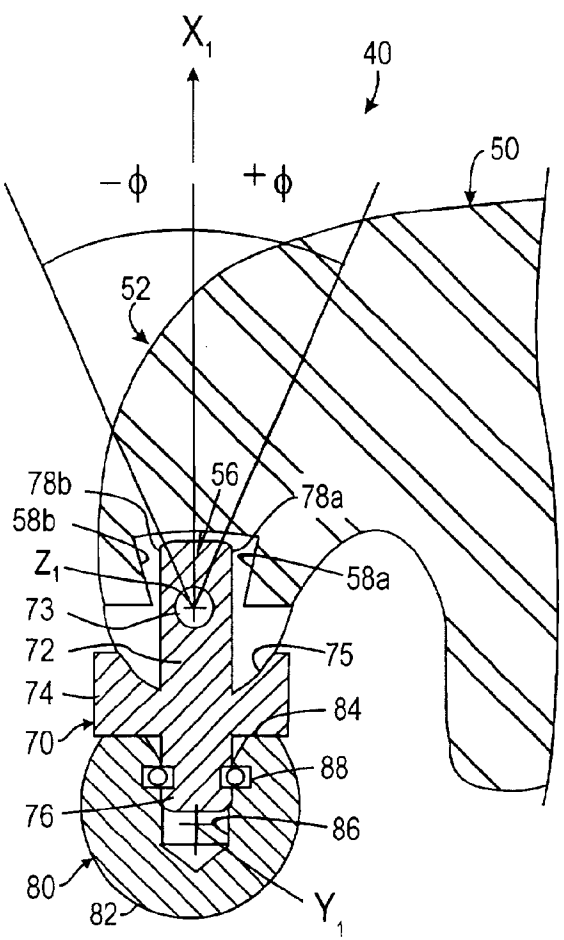
FIGS. 4A–B illustrate structures for preventing the $X_1$ axis of the assembly of FIGS. 2A–B from deviating significantly from true vertical.
Figure 4A:
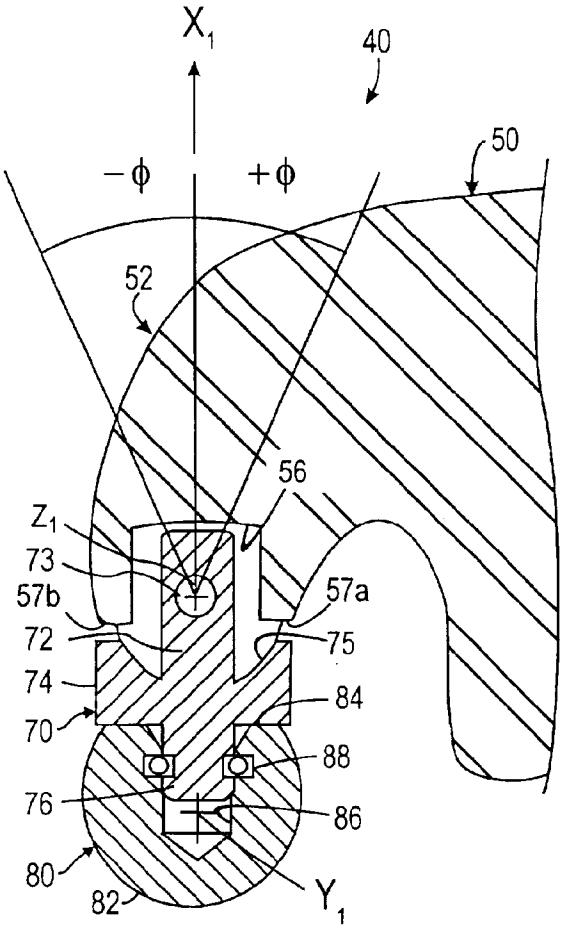

A structure may be required to restrict or limit the $X_1$ axis from deviating significantly from "true vertical." Referring to FIGS. 4A–B, limiting structures for preventing the $X_1$ axis of the assembly of FIGS. 3A–B from deviating significantly from "true vertical" are illustrated. The limiting structures to FIGS. 4A–B prevent second portion 80 from rotating on the $Z_1$ axis beyond a predetermined angle $\phi$. If the $X_1$ axis is not restricted, then movement of actuator arm 50 can cause the $X_1$ axis to deviate beyond the desired, predetermined angle $\phi$. Consequently, the $Z_1$ axis of hinge pin 73 can rotate about the $Y_1$ axis of second portion 80, thus preventing the motion of actuator arm 50 from being applied to the fitting. Rotation of the $Z_1$ axis about the $Y_1$ axis would only happen when actuator arm 50 is perpendicular to the axial dimension of the tube to be fitted and not when actuator arm 50 is articulated.

In FIG. 4A, a first limiting structure is provided on articulating coupling 40 of FIGS. 3A–B above. The first limiting structure includes mechanical stops 57*a* and 57*b*, which are extended features of surface 54 of actuator arm 50. Mechanical stops 57*a* and 57*b* respectively contact upper surfaces of middle section 74 of first portion 70. Contact between mechanical stops 57*a* and 57*b* and middle section 74 respectively limit rotation of second portion 80 about the $Z_1$ axis to plus or minus the desired, predetermined angle $\phi$.

In FIG. 4B, a second limiting structure is provided on articulating coupling 40 of FIGS. 3A–B above. The second limiting structure includes a pocket defined in surface 54 of actuator arm 50. The pocket has first and second sides 58*a* and 58*b*. First and second sides 58*a* and 58*b* respectively contact sides 78*a* and 78*b* of upper section 72 of first portion 70. Contact between sides 78*a* and 78*b* with sides 58*a* and 58*b* respectively limit rotation of second portion 80 about the $Z_1$ axis to plus or minus the desired, predetermined angle $\phi$. As actuator arm 50 is moved during a crimping operation, the desired, predetermined angle $\phi$ is at least large enough to allow a sufficient amount of rotation of first and second pins 70 and 80 about third axis $Z_1$ to prevent binding of the assembly 40 in FIGS. 4A and 4B.

Figure 5A:
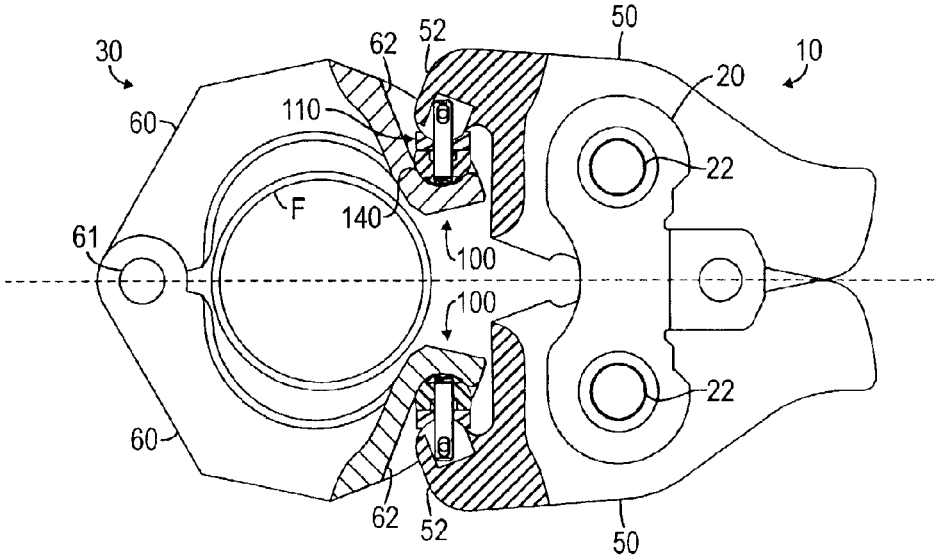
FIGS. 5A–B illustrate side and top views of another embodiment of an assembly for articulating a crimp ring relative to an actuator arm according to certain teachings of the present disclosure.
Figure 5B:
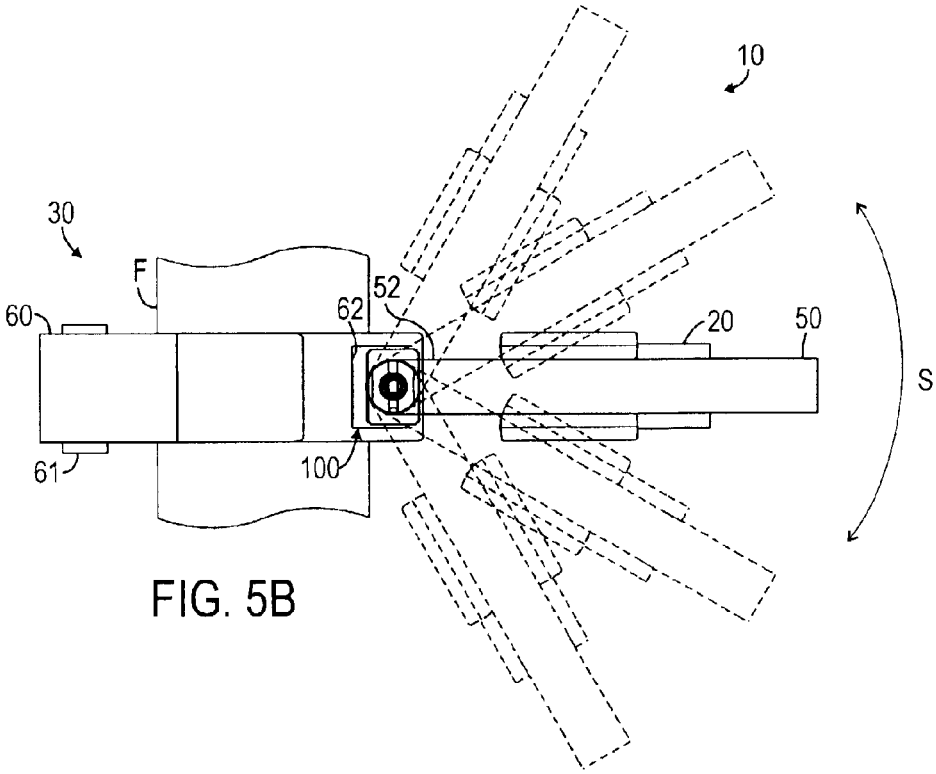

Referring to FIGS. 5A–B, another embodiment of a coupling 110 for articulating a crimp ring 30 relative to an actuator 10 according to certain teachings of the present disclosure is illustrated in a side and a top view respectively. As is known, crimp ring 30 includes a plurality of segments 60 (shown with two segments 60 in FIG. 5A) that are pivotably connected together for engaging and crimping a fitting F. As is also known, actuator 10 includes actuator arms 50 coupled together by side plates 20 and pivoting on pivot pins 22 for actuating crimp ring 30.

The articulating couplings 100 couple between end portions 52 of each actuator arm 50 and pivot ports 62 defined in the crimp ring segments 60. Each articulating coupling 100 includes first and second articulating portions 110 and 140. During a crimping operation, a drive member (not shown) known in the art engages the arms 50 causing them to pivot on pins 22. The pivoting of arms 50 generate forces at the ends 52 of the arms 50. As best shown in FIG. 5A, the articulating couplings 100 transfers the force at the ends 52 of arms to the crimp ring segments 60, thereby forcing the segments 60 against fitting F. As best shown in FIG. 5B, the articulating couplings 100 also allow the ends 52 of the actuator arms 50 to connect with the pivot ports 62 of the segments 60 from a plurality of angular orientations S that enables an operator to actuate crimp ring 30 with actuator 10 when there is obstructed or limited accessibility.

Figure 6:
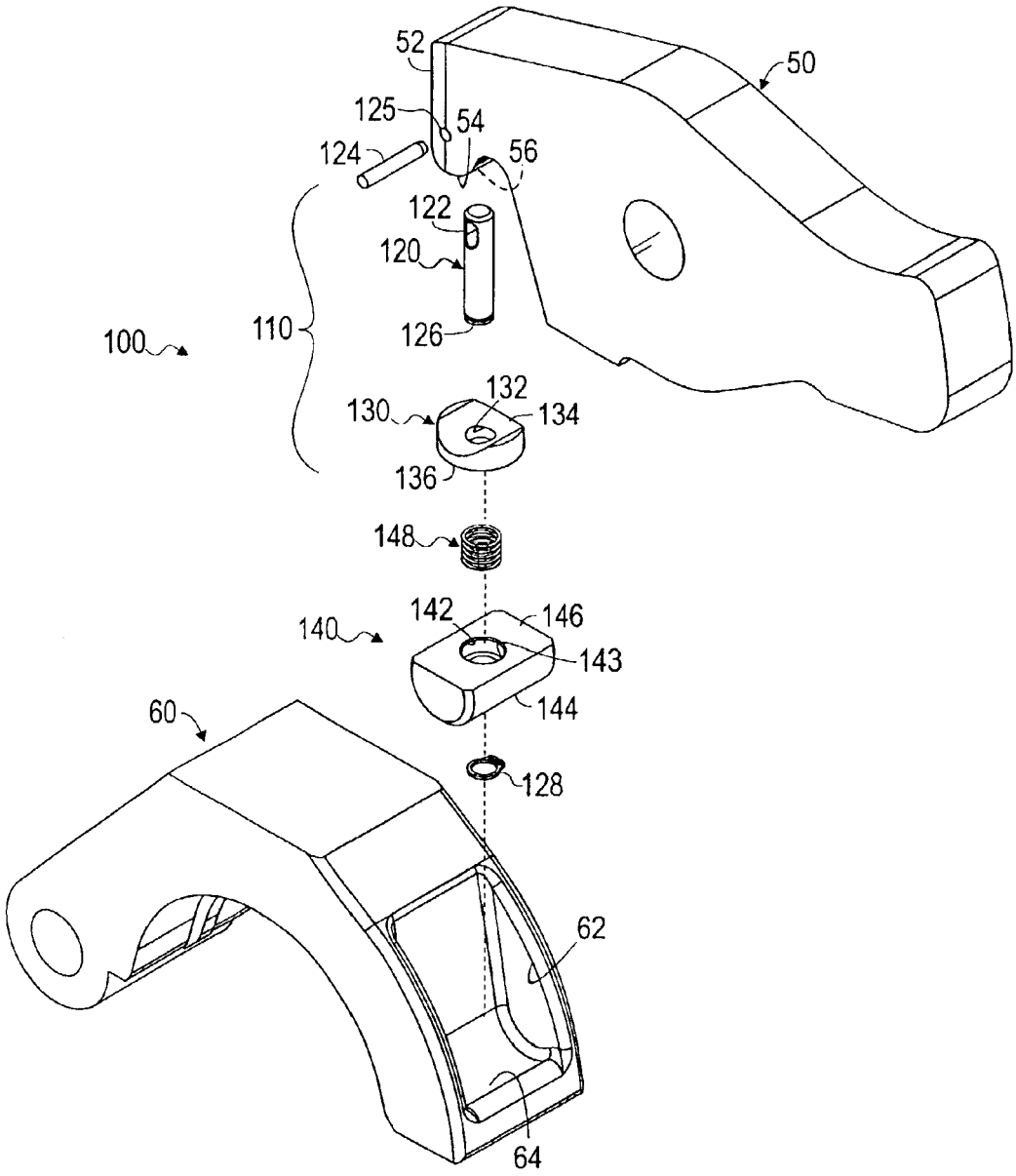
FIG. 6 illustrates an exploded view of the assembly of FIGS. 5A–B.
Figure 7B:
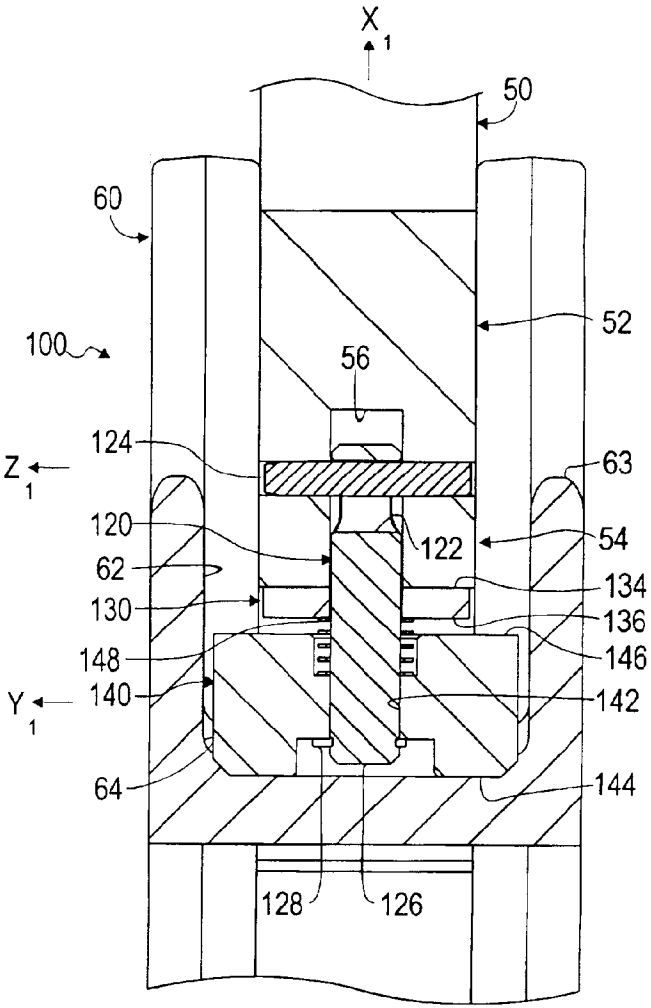
FIGS. 7A–B illustrate a side cross-section and an end cross-section of the assembly of FIG. 5A–B.
Figure 7A:
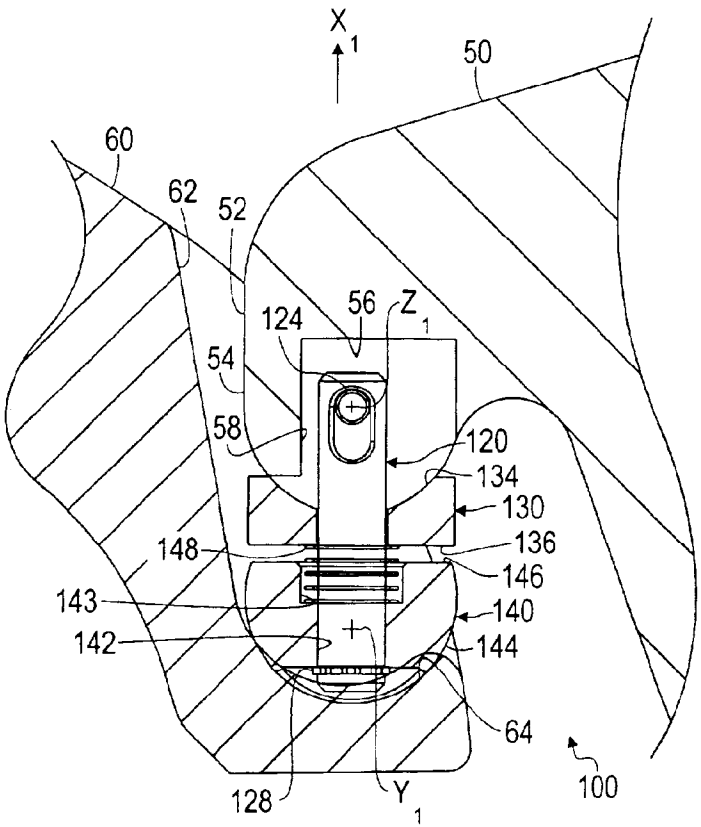

Referring to FIGS. 6 and 7A–B, one articulating coupling 100 of FIGS. 5A–B is illustrated in various views. In FIG. 6, articulating coupling 100 is illustrated in an exploded view relative to an actuator arm 50 and a crimp ring segment 60. In FIGS. 7A–B, articulating coupling 100 is illustrated in an assembled state and shown from respective side and end cross-sections. As best shown in the exploded view of FIG. 6, first articulating portion 110 includes an axial pin 120 and a cam member 130. An upper end of axial pin 120 has a cross or transverse hole 122, and a lower end has a slot 126 for a retaining clip 128 as described below. The upper end of axial pin 120 positions in a slot 56 defined in curved end 54 of actuator arm 50, and a hinge pin 124 fits through a hole 125 in end 52 of actuator arm 50 and through hole 122 to connect axial pin 120 in slot 56. Transverse hole 122 is preferably elongated along the axial length of pin 120. Cam member 130 defines a hole 132 for axial pin 120, and slotted end 126 of axial pin 120 fits though hole 132 in cam member 130 so that cam member 130 is slideably positioned on axial pin 120. Cam member 130 has a curved surface 134 for engaging curved end 52 of actuator arm 50 and has a flat surface 136 for engaging second articulating portion 140.

Second articulating portion 140 has a transverse hole 142, a partial cylindrical surface 144, and a flat surface 146. Partial cylindrical surface 144 is intended to engage bottom surface 64 of pocket 62 in crimp ring segment 60 when installed therein. Flat surface 146 is intended to engage flat surface 136 of cam member 130. To assemble, slotted end 126 of axial pin 120 having cam member 130 already positioned thereon is fitted through a biasing spring 148 and into transverse hole 142 in second articulating portion 140. Spring clip 128 attaches to slotted end 126 of axial pin 120 and holds second articulating portion 140 on axial pin 120. In this way, second articulating portion 140 is rotatably coupled to and fixedly attached on axial pin 120. Spring 148 fits within a counter bore 143 in transverse hole 142 in second articulating portion 140 and urges cam member 130 and second articulating portion 140 apart from one another. When not in use, spring 148 preloads articulating coupling 100 so that articulating coupling 100 stays in place and is not loosely held on end 52 of arm 50.

When assembled as shown in FIGS. 7A–B, articulating coupling 100 has several degrees of freedom. Axial pin 120 can pivot on hinge pin 124. To limit the potential loose pivot of axial pin 120, end 52 of arm 50 may define a stop 58. Axial pin 120 can also slide relative to hinge pin 124 because cross-hole 122 is elongated along the axial length of pin 120. Second articulating portion 140 can rotate relative to axial pin 120. In addition to several degrees of freedom, articulating coupling 100 provides substantial contact between arm 50 and segment 60 to transfer crimping loads. The engagement of cam surface 134 with curved end 54 of actuator arm 50 allows cam member 130 to slide against end 52 and maintain substantial contact therewith, thereby increasing the contact area between arm 50 and second articulating portion 140. In addition, the engagement of bottom surface 136 of cam member 130 with a flat surface 146 on second articulating portion 140 increases the contact area between arm 50, cam member 130, and second articulating portion 140. Furthermore, second articulating portion 140 having partial cylindrical surface 144 has substantial contact with bottom surface 64 of pivot port 62. These increased areas of contact reduce detrimental effects on arm 50 and crimp ring segment 60 due to force, contact stress, wear, and fatigue.

To operate articulating coupling 100, second articulating portion 140 is positioned into pivot port 62 of crimp ring segment 60. As best shown in FIG. 7B, pivot port 62 may define guiding sidewalls 63 to facilitate the positioning of second articulating portion 140 in port 62. Partial cylindrical surface 144 engages rounded bottom 64 of pivot port 62. Once engaged, actuator arm 50 and crimp ring segment 60 can articulate relative to one another about a first axis $X_1$ of articulation defined by second articulating portion 140 being rotatable on axial pin 120. With the articulation of arm 50 about axial pin 120, an operator can angle arm 50 relative to ring segment 60 when perpendicular access to the fitting is restricted, as shown above in FIG. 5B.

As best shown in FIG. 7B, actuator arm 50 and crimp ring segment 60 can also articulate relative to one another about a second axis $Y_1$ provided by partial cylindrical surface 144 of second articulating portion 140 being rotatable within rounded bottom 64 of pivot port 62. Second axis $Y_1$ is substantially perpendicular to first axis $X_1$. Articulation of arm 50 about second axis $Y_1$ accommodates for movement of arm 50 and segment 60 due to their separate pivot points. As noted above in FIG. 5A, for example, arm 50 pivots about pivot pin 22 of actuator assembly 10, while crimp ring segment 60 pivots about pivot pin 61 hingedly connecting segment 60 with other segment.

In addition, articulating coupling 100 is able to articulate about a third axis $Z_1$ relative to actuator arm 50. Third axis $Z_1$ is provided by engagement of curved, top surface 134 of cam member 130 with curved end 54 of arm 50, which both preferably define the same radius of curvature. Third axis $Z_1$ is defined at the center of the radius of curvature between the engaged curved surface 134 and end 54 and is substantially perpendicular to first axis $X_1$. Crimping loads during a crimping operation are transferred from curved end 54 of arm 50 to curved surface 134 of cam member 130. Crimping loads on end 52 of actuator arm 50 can reach thousands of pounds, and hinge pin 124 cannot tolerate such loads. Consequently, crimping loads are preferably not transferred to the relatively small hinge pin 124, which is merely used to keep articulating coupling 73 on arm 50. The elongated, transverse hole 122 allows end 54 to engage surface 134 despite differences in manufacturing tolerances without transferring load to hinge pin 124. Actuator arm 50 is able to articulate about third axis $Z_1$ relative to articulating coupling 100, which helps prevent binding between actuator arm 50 and segment 60 during a crimping operation. Cam member 130 having curved surface 134 and flat surface 136 enables the pivoting motion of end 52 of arm 50 to be transferred substantially perpendicular to a plane substantially parallel to the second axis $Y_1$ of articulation.

Figure 8B:
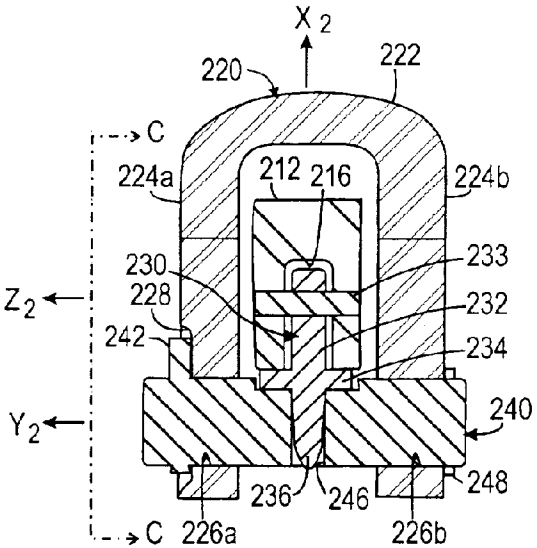
FIGS. 8A–C illustrate various view of another embodiment of an assembly for articulating a crimp ring relative to an actuator arm according to certain teachings of the present disclosure.
Figure 8C:
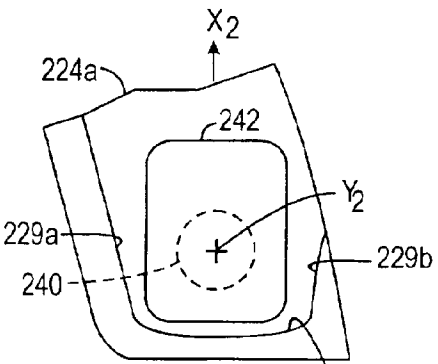
Figure 8A:
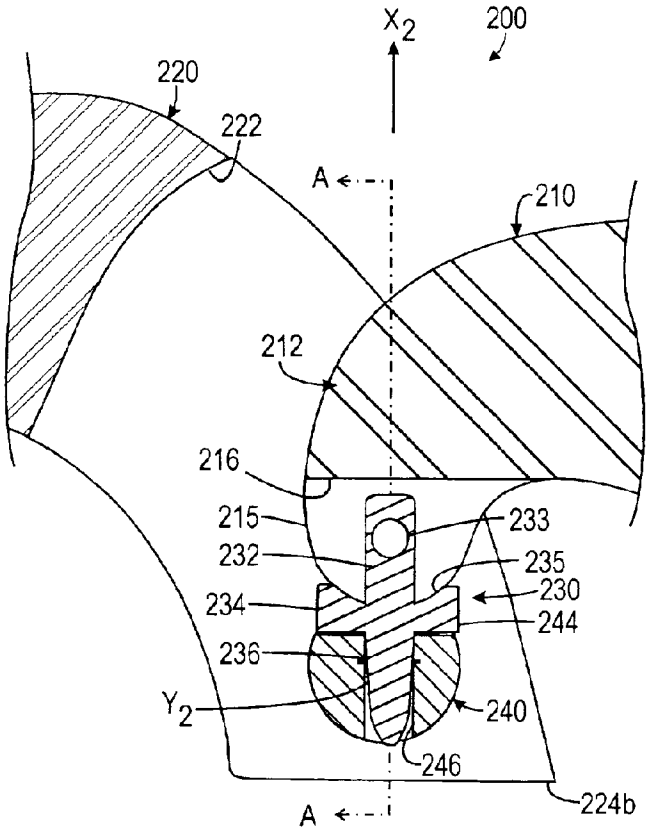

Referring to FIGS. 8A–C, another embodiment of an articulating coupling 200 between an actuator arm 210 and a ring segment 220 is illustrated. In FIG. 8A, articulating coupling 200, a portion of arm 210, and a portion of segment 220 are illustrated in side cross-section. In FIG. 8B, articulating coupling 200, a portion of arm 210, and a portion of segment 220 are illustrated in a front cross-section A—A of FIG. 8A. In FIG. 8C, articulating coupling 200 and a portion of segment 220 are illustrated in a side view B—B of FIG. 8B. For simplicity, only one articulating coupling 200 is illustrated between one actuator arm 210 and one crimp ring segment 220. It is understood that a second articulating connection may be similarly formed between a second actuator arm and a second crimp ring segment.

Actuator arm 210 includes an end portion 212 having a slot 216 defined in its distal end. As best shown in FIG. 8B, ring segment 220 includes forked sides 224*a* and 224*b* on a bifurcate end or holder 222, which receives end portion 212 between sides 224*a* and 224*b*. Articulating coupling 200 includes a first axial member or articulating pin 230 and a second axial member or articulating pin 240. First articulating pin 230 has an upper section 232, a middle section 234, and a lower section 236. Upper section 232 is disposed in slot 216 and is connected to end portion 212 with a pin 233. As best shown in FIG. 8A, middle section 234 has a curved surface 235 adjacent a rounded, distal end 215 of end portion 212 and has a flat surface 244 adjacent second pin 240. Lower section 236 extends from middle section 234 and is disposed in a cross-hole 246 defined in second pin 240. First pin 230 and second pin 240 are pivotable relative to one another.

As best shown in FIG. 8B, second pin 240 is rotatably disposed through apertures 226*a* and 226*b* in forked sides 224*a* and 224*b* of ring segment 220. External retaining rings 248 hold second articulating pin 240 therein. Second articulating pin 240 includes a tab 242 on one or more ends. Tab 242 is disposed in a pocket 228 defined in the outside surface of one of fork sides. Pocket 228 has raised sides 229*a* and 229*b*. In this case, pocket 228 is cast or milled in the outside surface of forked side 224*a*. Tab 242 has a rectangular shape eccentrically located on the end of second pin 240. Tab 242 rotates with pin 240 and limits rotation of the pin between first and second limits where tab 242 contacts the raised sides 229*a* or 229*b* of pocket 228. It is understood that additional techniques known in the art can be used for limiting the rotation of second pin 240 within bifurcate end 222.

To form articulating coupling 200, end portion 212 is positioned between forked sides 224*a* and 224*b* of bifurcate end 222. Lower section 236 of first pin 230 is loosely disposed in cross-hole 246 of second pin 240. Middle section 234 is positioned adjacent a flat portion 244 defined on second pin 240. Middle section 234 and flat portion 244 increase the contact area between arm 210 and ring segment 220 to reduce contact stress, as does the engagement of surface 235 with distal end 215.

Once coupled, actuator arm 210 and ring segment 220 can articulate relative to one another about a first axis $X_2$ provided by lower section 236 being rotatable within cross-hole 246. As best shown in FIG. 8B, actuator arm 210 and ring segment 220 can also articulate relative to one another about a second axis $Y_2$ provided by second pin 240 being rotatable within apertures 226*a* and 226*b* in sides 224*a* and 224*b* of segment 220. As noted above, articulation about second axis $Y_2$ is limited by tab 242 so that cross-hole 246 is readily accessible for coupling with lower section 236. To prevent binding, actuator arm 210 is further able to articulate about a third axis $Z_2$ relative to the first and second pins 230 and 240 provided by engagement of end 215 and surface 235.

The engagement of surface 235 with end 215 allows middle section 234 to slide against end 215 and maintain substantial contact therewith to increase the contact area between pin 230 and arm 210. In addition, the engagement of middle section 234 and flat portion 244 increases the contact area between articulating pins 230 and 240. Furthermore, second pin 240 being disposed between sides 224*a* and 224*b* has substantial contact with bifurcate end 222 of segment 220. These increased areas of contact reduce detrimental effects on arm 210 and ring segment 220 due to force, contact stress, wear, and fatigue.

It is understood that a reverse assembly of the embodiment discussed above can be used for articulating an actuator arm relative to a ring segment. In such a reversed embodiment, an end portion can have a bifurcate end defined by first and second sides. A first articulating pin can be rotatably disposed in apertures defined in the sides of an actuator arm. A ring segment can include a second articulating pin attached thereto and having a distal end projecting therefrom. The first articulating pin can rotatably couple to the second articulating pin to assemble the reversed arrangement of the articulating coupling.

Figure 9:
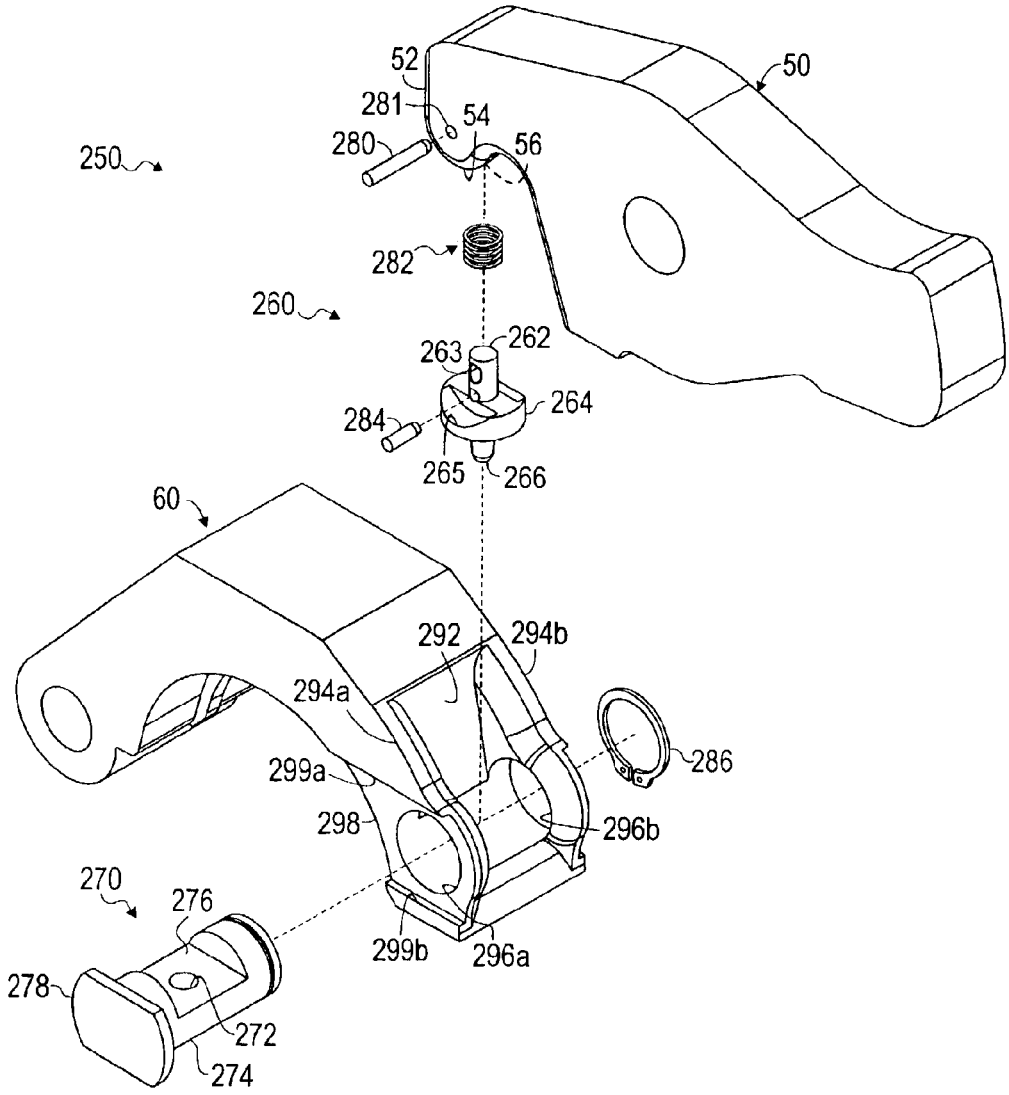
FIG. 9 illustrates an exploded view of another embodiment of an assembly for articulating a crimp ring relative to an actuator arm according to certain teachings of the present disclosure.
Figure 10B:
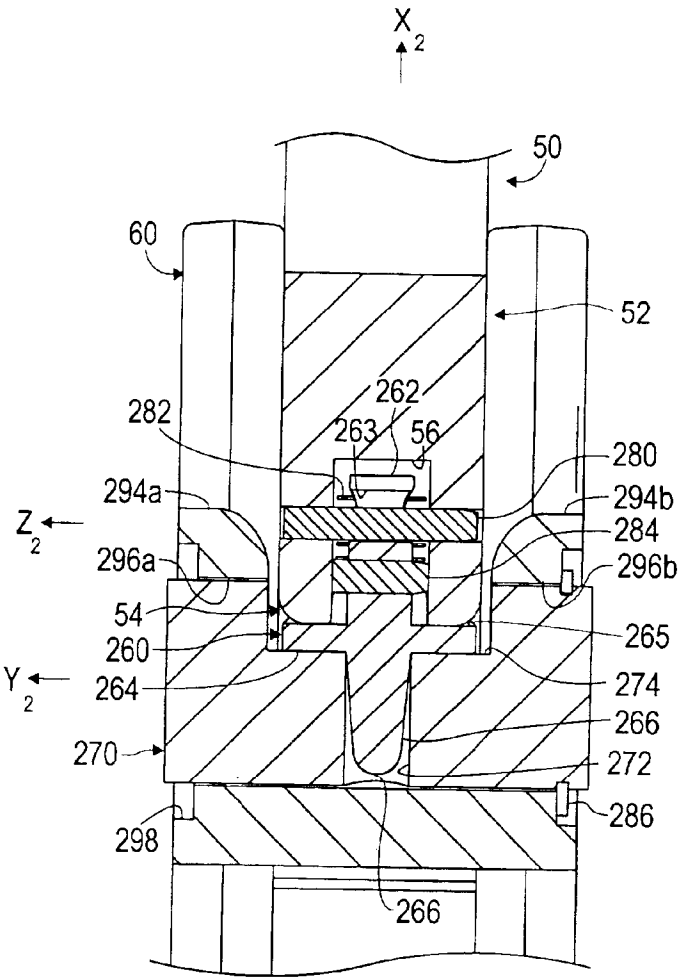
FIGS. 10A–B illustrate a side cross-section and an end cross-section of the assembly of FIG. 9.
Figure 10A:
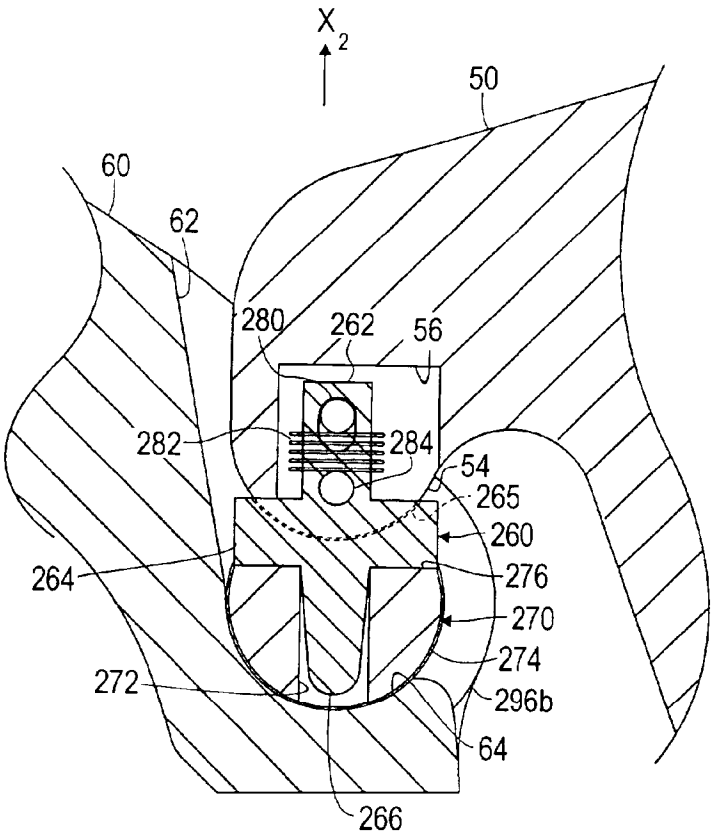

Referring to FIGS. 9 and 10A–B, another embodiment of an articulating coupling 250 between an actuator arm 50 and a crimp ring segment 60 is illustrated. In FIG. 9, articulating coupling 250 is illustrated in an exploded view. In FIGS. 10A–B, articulating coupling in an assembled state is illustrate in side and end cross-sections. Actuator arm 50 includes an end portion 52 having a curved surface 54 and a slot 56. Crimp ring segment 60 includes forked sides 294*a* and 294*b* on a bifurcate end 292. Bifurcate end 292 receives end portion 52 between sides 294*a* and 294*b*.

Articulating coupling 250 includes a first articulating portion 260 and a second articulating portion 270. First articulating portion 260 has an upper section 262, a middle section 264, and a lower section 266. Upper section 262 is an axial pin defining an elongated cross-hole 263. A biasing member 282 fits on upper section 262, and a second pin 284 fits into another hole in upper section 262 to engage a lower end of biasing member 282. Upper section 262 is disposed in slot 56 and connected to actuator end 52 by a hinge pin 280 fitting through a hole 281 in actuator end 52 and through the elongated cross-hole 263. Thus, first articulating portion 260 is hingedly connected to end 52 of arm 50, and biasing member 282 between pins 280 and 284 preloads first articulating member 260 to remain in place when not in use. Middle section 264 is a cam member integrally connected to upper section 262. Middle section 264 has curved surfaces 265 for engaging curved end 54 of end portion 52. Middle section 264 also has a flat, bottom surface for engaging second articulating portion 270. Lower section 266 is an axial pin integrally connected to middle section 264 and extending therefrom for positioning in a transverse hole 276 defined in second articulating portion 270.

Second articulating portion 270 is rotatably positioned in a bifurcate end or holder 292 having apertures 296*a* and 296*b* defined in forked sides 294*a* and 294*b* of crimp ring segment 60. Second articulating portion 270 defines a hole 272, a partial cylindrical surface 274, and a flat surface 276. On one end, second articulating portion 270 includes a tab 272 that positions within a pocket 298 defined in the outside surface of one of fork sides 296*a*. On another end, an external retaining ring 286 attaches to second articulating portion 270 to hold it in apertures 296*a* and 296*b*. With rotation of second articulating portion 270, tab 272 can engage raised sides 299*a* or 299*b* of pocket 298, which limits rotation of second articulating portion 270 between first and second limits.

To form articulating coupling 250, lower section 266 of first articulating portion 260 is removably positioned in hole 276 of second articulating portion 270. Flat, bottom surface of middle section 234 engages a flat surface 274 defined on second articulating portion 270. Middle section 264 and flat surface 274 increase the contact area between arm 50 and ring segment 60 to reduce contact stress, as does the engagement of rounded surfaces 265 with distal end 65 of actuator arm 50.

Once coupled, actuator arm 50 and crimp ring segment 60 can articulate relative to one another about a first axis $X_2$ provided by lower section 266 being rotatable within hole 276, as best shown in FIG. 10A. Actuator arm 50 and crimp ring segment 60 can also articulate relative to one another about a second axis $Y_2$ provided by second articulating portion 270 being rotatable within apertures 296*a* and 296*b* in crimp ring segment 60, as best shown in FIG. 10B. As noted above, articulation about second axis $Y_2$ is limited by tab 272 so that hole 276 is readily accessible for coupling with lower section 266. Actuator arm 50 can also articulate about a third axis $Z_2$ relative to first and second articulating portion 260 and 270 provided by contact of curved end 52 against curved surfaces 265 of middle section 260, as also best shown in FIG. 10B. The engagement of surface 265 with end 54 allows middle section 264 to slide against end 54 and maintain substantial contact therewith, thereby increasing the contact area between articulating portion 260 and arm 50. In addition, the engagement of middle section 264 and flat surface 274 increases the contact area between articulating portions 260 and 270. Furthermore, because second articulating portion 260 is disposed in bifurcate end 292, it has substantial contact with sides 294*a* and 294*b* of segment 60. These increased areas of contact reduce detrimental effects on arm 50 and crimp ring segment 60 due to force, contact stress, wear, and fatigue.

B. Insertable Articulating Assembly for Arms

Figure 11B:
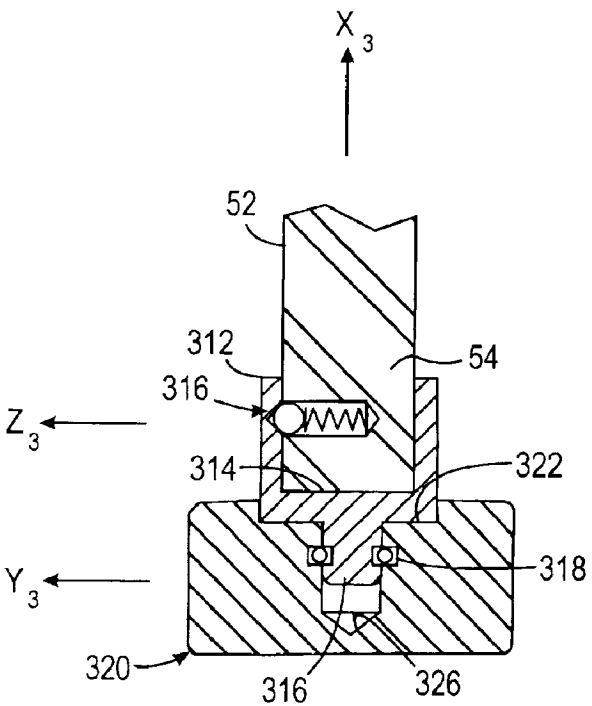
FIGS. 11A–B illustrate embodiments of insertable assemblies for articulating a crimp ring relative to a conventional actuator arm according to certain teachings of the present disclosure.
Figure 11A:
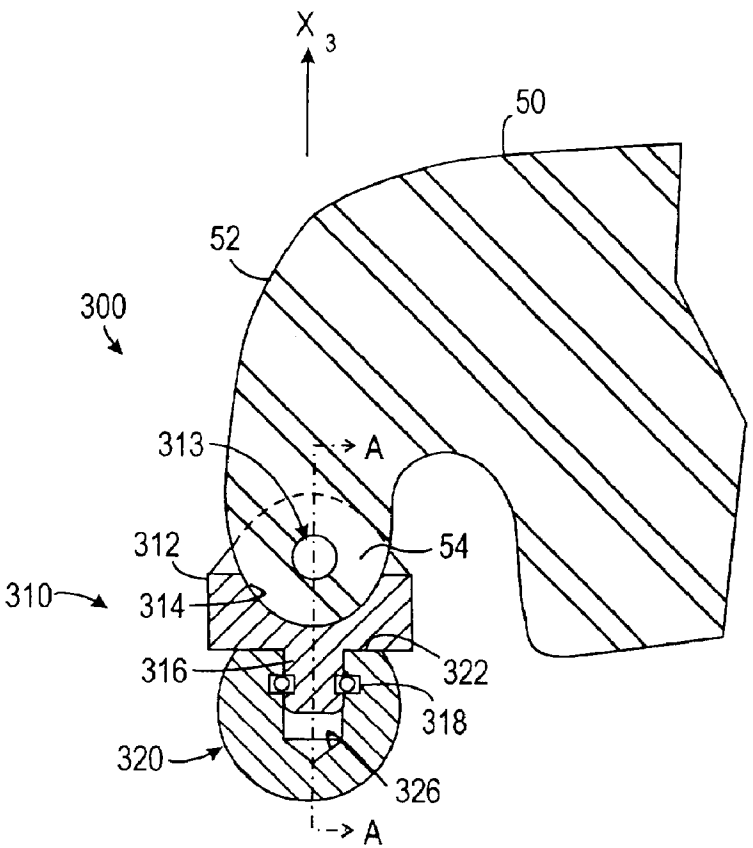

Referring to FIGS. 11A–B, an embodiment of an insertable assembly 300 for articulating a ring segment (not shown) relative to a conventional actuator arm 50 is illustrated. In FIGS. 11A–B, articulating insertable assembly 300 and a portion of arm 50 are illustrated in side and end cross-sectional views. Insertable assembly 300 temporarily couples to conventional actuator arm 50 and the ring segment and allows arm 50 to be articulated relative to the ring segment when access to a fitting (not shown) is restricted in some way. For simplicity, only one insertable assembly 300 is illustrated. It is understood that a second insertable assembly may be similarly used between a second actuator arm and a second crimp ring segment.

Insertable assembly 300 includes an attachment portion 312 and an articulating portion 320. Attachment portion 312 removably attaches to end portion 52. Attachment portion 312 defines an inner surface 314, which contacts a distal end 54 of end portion 52 when inserted thereon. As best shown in FIG. 11A, inner surface 314 is preferably contoured or curved in cross-section to substantially contact distal end 54. As best shown in FIG. 11B, inner surface 314 is rectilinear in end-section to fit against distal end 54 of conventional end portion 52. To prevent binding, distal end 54 and surface 314 are able to move relative to one another so that insertable assembly 300 can articulate on distal end 54 about an axis $Z_3$.

Insertable assembly 300 can be slip fit onto distal end 54, can be magnetically attached onto end 54, can be held by a removable cross-pin (not shown) disposed through attachment portion 312 and distal end 54, or can be otherwise temporarily attached onto end 54 by methods known in the art. For example, attachment portion 312 and distal end 54 in the present embodiment include a retaining structure 163, which temporarily holds insertable assembly 300 on distal end 54 and allows them to pivot relative to one another. Retaining structure 313 includes a spring-loaded ball detent on distal end 54. A bore for the spring and ball is defined in a side of distal end 54. The bore is at a center of radius of distal end 54 so that distal end 54 and surface 314 can move relative to one another during a crimping operation. The surface of attachment portion 312 adjacent the ball detent defines a recessed feature for engaging the ball and temporarily holding insertable assembly 300 on distal end 54.

Articulating portion 320, which is a cylindrical member as best shown in FIG. 11B, is coupled to attachment portion 312 and disposes in a pivot port (not shown) of the crimp ring segment. A shaft 316 extends from attachment portion 312 and is disposed in a cross-hole 326 defined in articulating portion 320. Articulating portion 320 is rotatable on shaft 316 about an axis $X_3$. A retainer or spring clip 318 is used to keep articulating portion 320 attached to shaft 316, yet still allow for rotation of articulating portion 320 thereon. Articulating portion 320 defines a flat surface 322 contacting attachment portion 312. When disposed in the pivot port of the ring segment, articulating portion 320 is rotatable therein about an axis $Y_3$.

C. Intermediate Articulating Assemblies

Referring to FIGS. 12A–B and FIGS. 13A–B, intermediate assemblies 400 and 410 for articulating conventional actuator arms relative to a crimp ring are illustrated. Intermediate articulating assemblies 400 and 410 are used in combination with conventional crimp rings and actuator arms and are not intended to articulate in relation to the crimp ring. Instead, assemblies 400 and 410 temporarily couple in-line with the crimp ring and are then accessible from alternate angles by the conventional actuator arms.

Figure 12B:
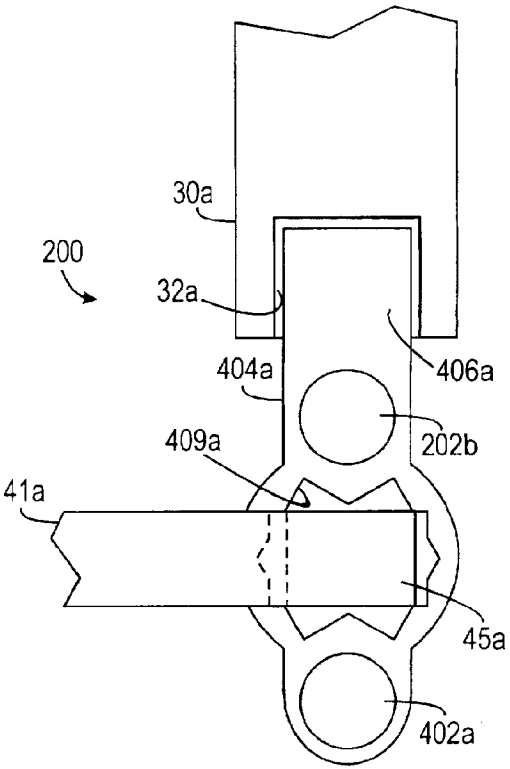
FIGS. 12A–B illustrate an embodiment of a sliding, intermediate assembly for articulating a crimp ring relative to conventional actuator arms according to certain teachings of the present disclosure.
Figure 12A:
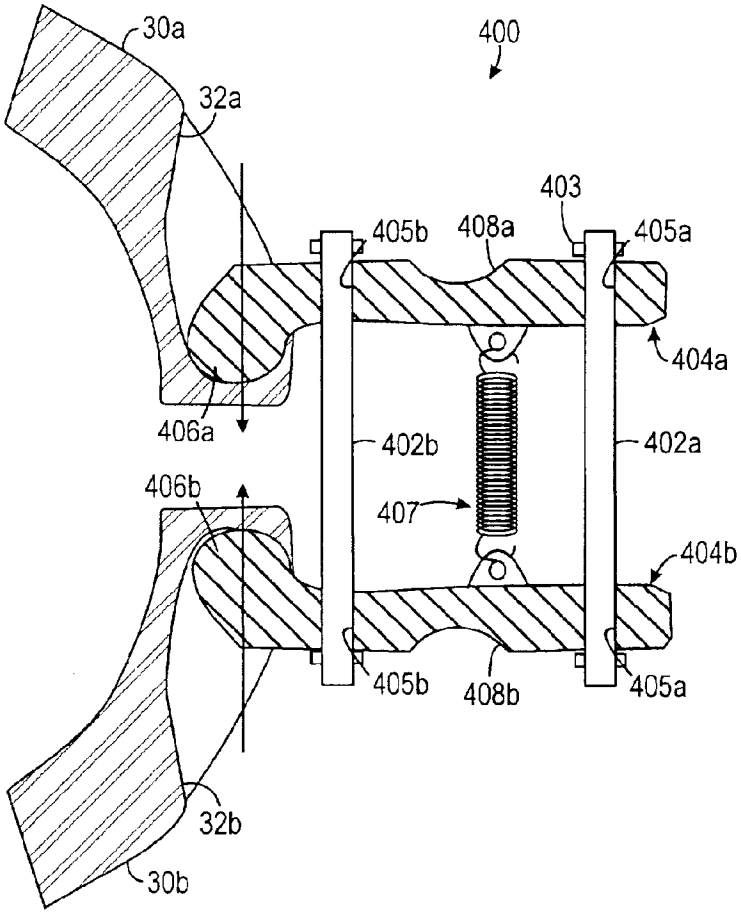

Referring to FIG. 12A, a sliding, intermediate assembly 400 is illustrated in a side cross-sectional view. Intermediate assembly 400 is coupled between a crimp ring having first and second segments 60*a* and 60*b* and an actuator having first and second arms (not shown). Intermediate assembly 400 includes first and second guide bars 402*a–b* and first and second coupling members 404*a–b*. Coupling members 404*a* and 404*b* each include a port end 406*a* and 406*b* positioning respectively in a pivot port 62*a* and 62*b* of segments 60*a* and 60*b*. Coupling members 404*a* and 404*b* each define cross-bores 405*a* and 405*b* where guide bars 402*a* and 402*b* pass through.

Coupling members 404*a* and 404*b* are slideable on guide bars 402*a* and 402*b*. Cross-bores 405*a* and 405*b* can include linear bearings to facilitate movement of members 404*a* and 404*b* on bar 402. Snap rings 403 are attached to ends of guide bars 402*a* and 402*b* to limit the separation of coupling members 404*a–b*. A biasing member 407, such as an extension spring, is attached to coupling members 404*a* and 404*b* to bias the coupling members toward each other and to hold the coupling members in place while the actuator arms are being engaged.

In addition, each coupling member 404*a* and 404*b* defines an indentation or port 408*a* and 408*b* receiving an end portion (not shown) of the actuator arms therein. Indentations 408*a* and 408*b* are positioned between guide bars 402*a* and 402*b* to reduce binding of coupling members 404*a* and 404*b* on the guide bars. Indentations 408*a* and 408*b* can have a hemispherical shape to accommodate hemispherical-shaped ends of actuator arms at any number of angular orientations.

Alternatively, sliding, intermediate assembly 400 can couple with standard, rectilinear ends of actuator arms. Referring to FIG. 12B, intermediate assembly 400 is illustrated in a top view, showing first coupling member 404*a* coupled to first segment 60*a* and receiving a conventional actuator arm 51*a*. It is understood that the other coupling member of intermediate assembly 400 is similarly arranged with a second segment and another arm of the actuator on a bottom side of the assembly. Intermediate assembly 400 couples substantially in-line with the crimp ring. In this embodiment, guide bars 402*a* and 402*b* have a circular cross-section, but could have other cross-sections. In FIG. 12B, coupling member 402*b* has a slotted indentation 409*a* in contrast to the hemispherical indentation of FIG. 12A. The other coupling member not shown in FIG. 12B, of course, has a similar, slotted indentation. Slotted indentation 409*a* includes specific slots or contours to accommodate a rectilinear end 55*a* of conventional actuator arm 21 a at a plurality of predefined angular orientations.

Figure 13B:
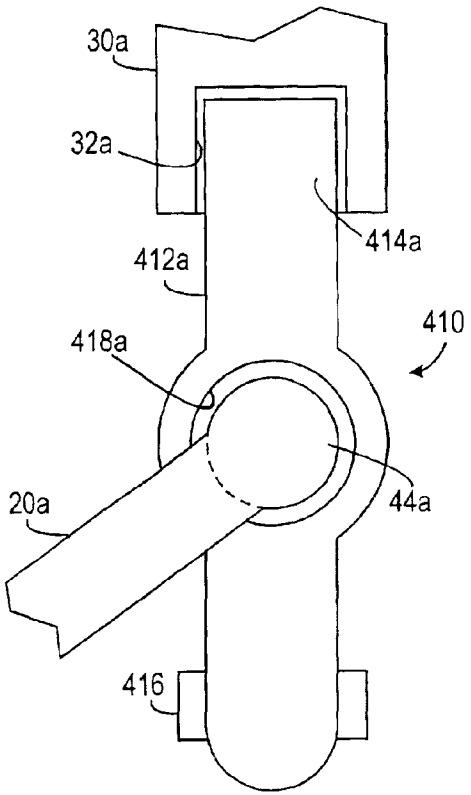
FIGS. 13A–B illustrate an embodiment of a pivoting, intermediate assembly for articulating a crimp ring relative to conventional actuator arms according to certain teachings of the present disclosure.
Figure 13A:
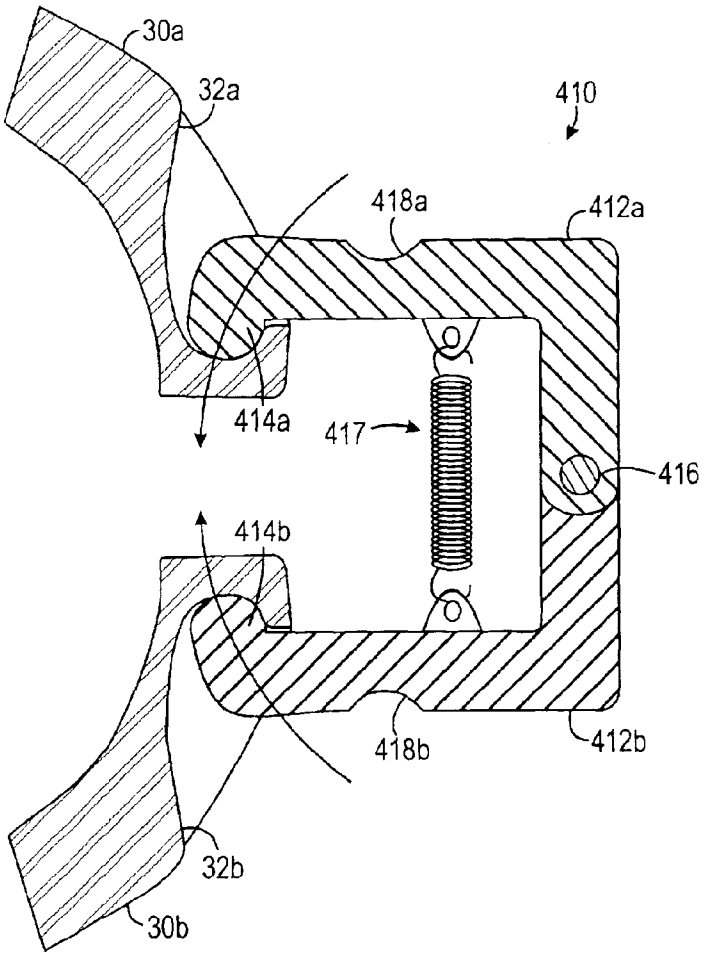

In an alternative to the sliding, intermediate assembly 400 described above, a pivoting, intermediate assembly 410 is illustrated in FIGS. 13A–B. Intermediate assembly 410 includes first and second coupling members 412*a* and 412*b* hingedly connected by a pivot pin 416. In FIG. 13A, intermediate assembly 410 is illustrated in a side cross-sectional view. Intermediate assembly 410 is coupled between first and second crimp ring segments 60*a* and 60*b* and actuator arms (not shown). Coupling members 412*a* and 412*b* each include a port end 414*a* and 414*b* positioning respectively in a pivot port 62*a* and 62*b* of segments 60*a* and 60*b*. A biasing member 417, such as an extension spring, is attached to coupling members 404*a* and 404*b* to bias the coupling members 404*a* and 404*b* toward each other and to hold them in place while the actuator arms are being engaged. In addition, each coupling member 404*a* and 404*b* defines an indentation or port 418*a* and 418*b* receiving an end portion (not shown) of the actuator arms therein. As best shown in the top view of FIG. 13B, indentations (only 408*a* is visible) have a hemispherical shape to accommodate or articulate a hemispherical-shaped end 54 of actuator arm 50*a* at any number of angular orientations.

Figure 14A:
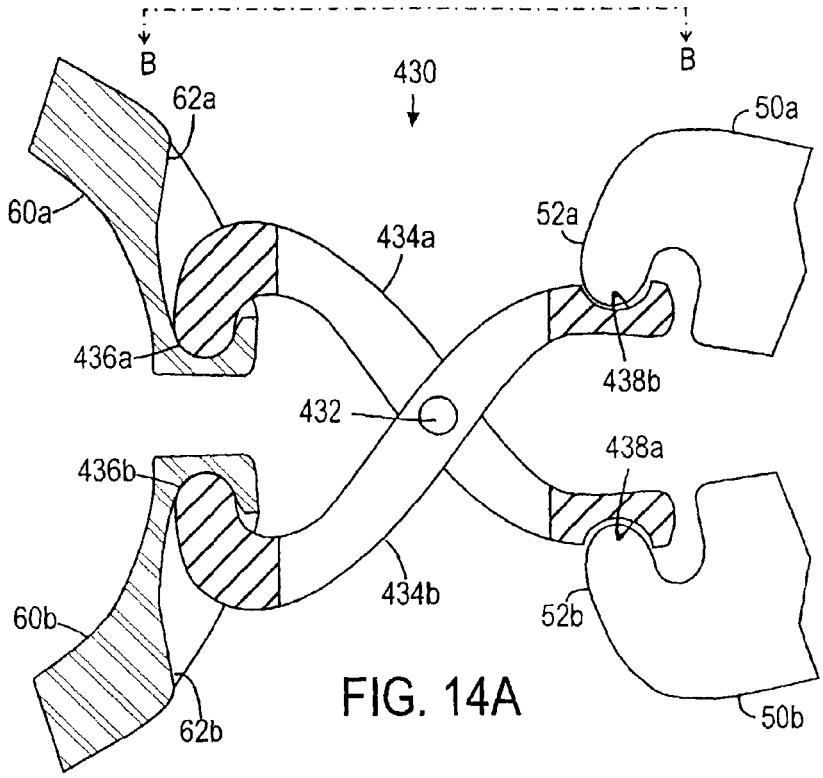
FIGS. 14A–B illustrate an embodiment of another intermediate assembly for articulating a crimp ring relative to conventional actuator arms according to certain teachings of the present disclosure.
Figure 14B:
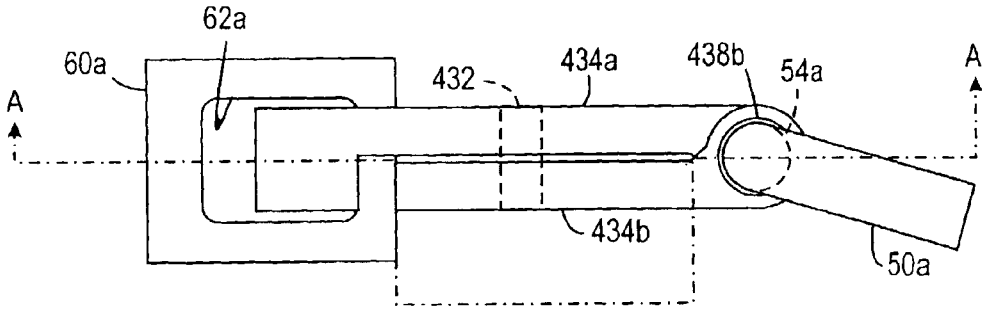

Referring to FIGS. 14A–B, another embodiment of an intermediate assembly 430 for articulating conventional actuator arms 50*a* and 50*b* relative to crimp ring segments 60*a* and 60*b* is illustrated. In FIG. 14A, intermediate assembly 430 is illustrated in a broken cross-sectional view to reveal details, and in FIG. 14B, intermediate assembly 430 is illustrated in a top view. Intermediate assembly 430 is coupled-between segments 60*a* and 60*b* and arms 50*a* and 50*b*. Intermediate assembly 430 is a scissor mechanism including a first coupling member 434*a* and a second coupling member 434*b* pivotably attached to one another with a pivot pin 432. The scissor mechanism of coupling members 434*a* and 434*b* may include a biasing member (not shown) to bias the ends 436*a* and 436*b* toward each other. Furthermore, the location of pivot pin 432 to connect members 434*a* and 434*b* can be selected to increase, decrease, or directly transfer the leverage provided by actuator arms 50*a* and 50*b*.

Coupling members 434*a* and 434*b* each include a port end 436*a* and 436*b* and define an indentation 438*a* and 438*b*. Port ends 436*a* and 436*b* are positioned respectively in pivot ports 62*a* and 62*b* of segments 60*a* and 60*b*. As best shown in FIG. 14B, intermediate assembly 430 couples substantially in-line with ring segments 60*a* and 60*b*. Indentations 438*a* and 438*b* are positioned on opposite ends of coupling members 434*a* and 434*b*. Indentation 438*a* and 438*b* have a hemispherical shape to accommodate hemispherical-shaped ends 54*a* and 54*b* of arms 50*a* and 50*b* at any number of angular orientations, but could also include slotted indentations receiving rectilinear ends of standard arms at a plurality of orientations.

For stability, port ends 436*a* and 436*b* and indentations 438*a* and 438*b* are aligned along the axial centerline of the scissor mechanism 430. To hold the coupling members in place while actuator arms 50*a* and 50*b* are being engaged, a compression spring (not shown) can be connected between coupling members 434*a* and 434*b* adjacent indentations 438*a* and 438*b*. Alternatively, an extension spring (not shown) can be connected between coupling members 434*a* and 434*b* adjacent port ends 436*a* and 436*b*, or a torsion spring (not shown) can be positioned at pivot 432 to similarly bias the coupling members.

D. Fixed Angle Actuator

Referring to FIGS. 15A–B and 16, embodiments of fixed angle actuators are illustrated. In FIGS. 15A–B, a fixed angle actuator 440 is illustrated in a top and perspective view. Fixed angle actuator 440 accesses a crimp ring at a predetermined degree of articulation. Fixed angle actuator 440 includes first and second arms 440*a* and 440*b*; first and second side plates 446 (one not shown); and first and second pivot pins 447*a* and 447*b*. Arms 440*a* and 440*b* include end portions 442*a* and 442*b*, having conventional, rounded ends 444*a* and 444*b*.

End portions 442*a* and 442*b* are angled at their point of connection 448*a* and 448*b* to the remaining portion of arms 440*a* and 440*b*. As best shown in FIG. 15A, end portions 442 fits within indentation 62 of a crimp ring segment 60. End portion 442 defines an angle θ at transition point 448 with respect to the remaining portion of arm 440 having pivot point 447.

Alternatively, end portions 442*a* and 442*b* can include an embodiment of an articulating connection or coupling as disclosed herein. For example, FIG. 16 illustrates a top view of fixed angle actuator 440. Although only one end is visible in the top view of FIG. 16, both actuator arms of the actuator 440 has a hemispherical end 448. Each hemispherical end 448 fits into an indentation 62 of a crimp ring 60. Using hemispherical ends 448 with fixed actuator 440 enables a tool 9 with actuator 440 to lie on a line 7 substantially parallel to an axial direction 6 of a tube 8 being fitted. This is advantageous when access to crimp the tube is limited.

E. Ball and Socket Assembly

Figure 17:
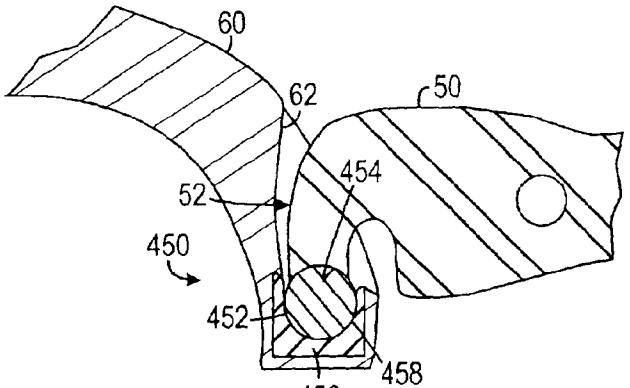

Referring to FIG. 17, an embodiment of a ball and socket assembly 450 for articulating an actuator arm 50 and crimp ring segment 60 in relation to one another is illustrated in cross-section. Ball and socket assembly 450 includes a spherical member or ball bearing 452 and a receptor or socket member 456. Arm 50 of the actuator has spherical member 452 attached to an end 454 of end portion 52.

Spherical member 452 is preferably a separate part that is cast, lathed, or machined. Spherical member 452 is retained on or attached to end portion 52 and can be attached by adhesion, welding, soldering, brazing, or other techniques known in the art. For example, spherical member 452 can be placed into a mold, and arm 50 can then be cast around the spherical member. Alternatively, spherical member 452 can be integrally cast as part of end portion 52 and can be machined to refine the surfaces. Socket member 456 is disposed in the lower portion of the pivot port or indentation 62 of crimp ring segment 60. Socket member 456 defines a spherical surface 458. To form the articulated connection, ball bearing 452 is removably coupled to socket member 456.

Socket member 456 is integrally cast with ring segment 60 and machined to provide an appropriate surface to mate with spherical member 452. Alternatively, socket member 456 is a separately produced element attached to ring segment 60. Contact between spherical member 452 and socket member 456 preferably includes features to increase the contact area between them to reduce contact stresses. For example, spherical member 452 and socket member 456 can include, exclusively or in combination, ductile metals or disparate strength materials to reduce contact stresses and reduce friction through the deformation of one material to fully mate with the other material.

For example, socket member 456 may be composed of or spherical surface 458 may be lined with a ductile metal. For example, a suitable ductile metal for socket member 456 is bronze. By increasing the contact area between the mated ball 452 and socket 456, the ductile metal reduces contact stress between them. Alternatively, both ball 452 and socket 456 may be composed of or covered with a ductile material to provide better seating and to avoid a single point contact between them. Ball 452 and socket 456 may also be composed of different strength materials to reduce contact stress. For example, a suitable material for ball 452 is steel, when used with socket member 456 composed of bronze.

F. Reversed Ball and Socket Assembly

Figure 18:
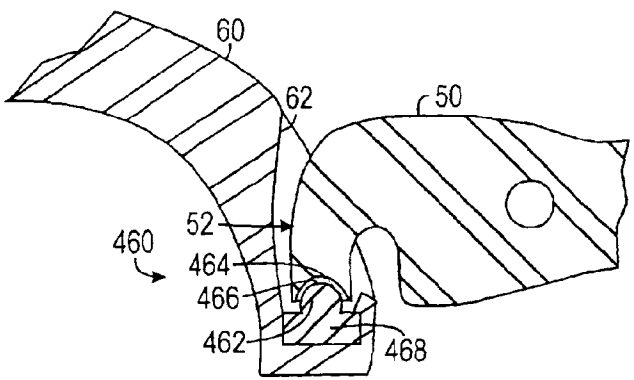
FIGS. 17–20 illustrate embodiments of ball and socket assemblies for articulating a crimp ring relative to an actuator arm according to certain teachings of the present disclosure.

Referring to FIG. 18, a reversed ball and socket assembly 460 for articulating ring segment 60 relative to actuator arm 50 is illustrated. Ball and socket assembly 460 includes a spherical member or ball bearing 462 and a receptor or socket member 464. Pivot port or indentation 62 of ring segment 60 has spherical member 462 attached therein. Arm 50 of actuator 52 defines receptor or socket member 464.

Ring segment 60 is cast with socket member 464 defined therein and is machined to provide an appropriate spherical surface 466. Alternatively, spherical member 462 is a separately produced element that is attached to ring segment 60 by adhesion, welding, soldering, brazing, or other techniques known in the art. Similar to ball and socket assembly 450 of FIG. 17, spherical member 462 and socket member 464 preferably include, exclusively or in combination, ductile metals or disparate strength materials to reduce contact stresses.

G. Lapped Ball and Socket Assembly

Figure 19:
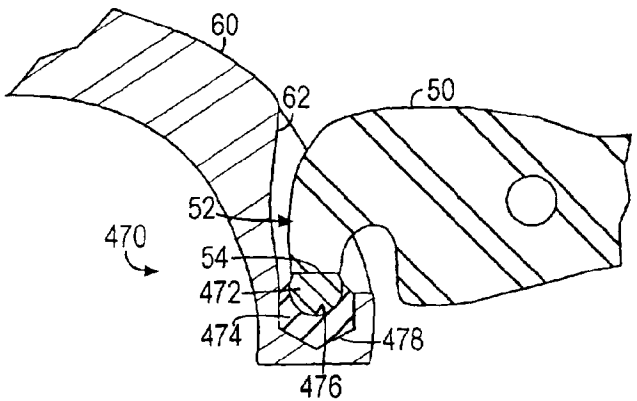

Referring to FIG. 19, another ball and socket assembly 470 for articulating actuator arm 50 relative to ring segment 60 is illustrated. Ball and socket assembly 470 includes a spherical member or ball bearing 472 and a receptor or socket member 474. Spherical member 472 with lapped socket 470 is attached to an end 54 of end portion 52. Spherical member 472 and socket member 474 are lapped together to provide a better mating of the two. Spherical member 472 is lapped in socket member 474 so that a substantial portion of member 472 contacts a spherical surface 476 defined by socket member 474.

To form the articulated connection between actuator arm 50 and ring segment 60, spherical member 472 with lapped socket member 474 is removably disposed in pivot port 62 of ring segment 60. Socket member 474 includes a lower surface 478, which is pointed in the present embodiment, but may be otherwise shaped or flat. Lower surface 478 of the socket member is positioned against the bottom of indentation 62. It will be appreciated, however, that lapping of the spherical member 472 with the socket member 474 can be done even if the parts are not removable.

H. Extension of Pivot Ports

Figure 20:
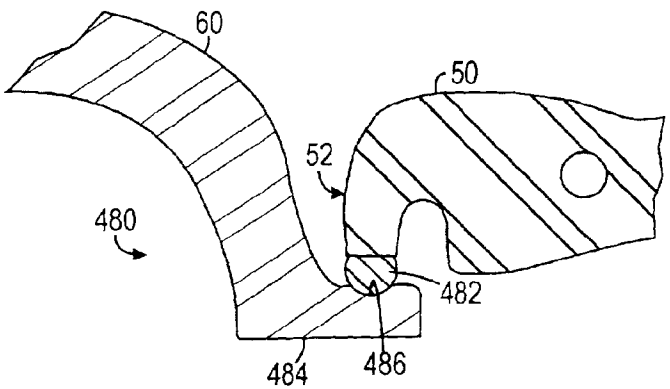

Referring to FIG. 20, another embodiment of a ball and socket assembly 480 for articulating actuator arm 50 relative to ring segment 60 is illustrated. Other articulated connections between arms and ring segments require the pivot ports or indentations to be deeply defined in the ring segments to receive the end portion of the arm. As illustrated in FIG. 20, ring segment 60 includes an extension 484, which eliminates the need for a deep pivot port to be defined in ring segment 60. Extension 484 includes a socket member 486 receiving a ball member 482 attached to end portion 52 of arm 50. In addition to eliminating the need for deep pockets in ring segment 60, extension 484 can also lower the amount of force required from the crimping tool (not shown). Extension 484 may be beneficial to other embodiments of articulated connections between arms and ring segments discussed herein or known in the art.

I. Ball End Assemblies

Figure 21B:
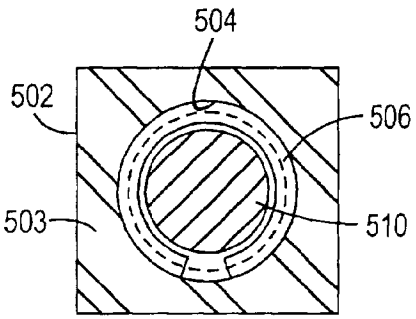
FIGS. 21A–B illustrate an embodiment of an articulating ball end assembly according to certain teachings of the present disclosure.
Figure 21A:
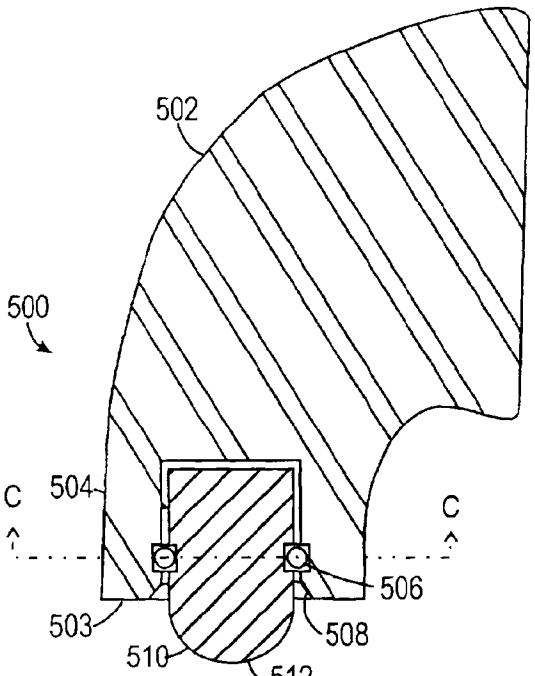

Referring to FIGS. 21A–B, an embodiment of an articulating ball end assembly 500 for an actuator arm 502 in accordance with certain teachings of the present disclosure is illustrated. In FIGS. 21A–B, ball end assembly 500 is illustrated in a side cross-sectional view and a bottom cross-sectional view, respectively. Actuator arm 502 has a hole 504 defined in a distal end of the actuator arm 502. The distal end of arm 502 has a flat surface 503 having a hole 504 drilled or cast therein.

An articulating member 510 is disposed in hole 504 and is held by a retainer 506. Articulating member 510 is cylindrical and has a hemispherical end 512 extending beyond hole 504 for engaging a pivot port of a crimp ring segment (not shown). Hole 504 may have a flat inner surface, as shown, to provide a substantial contact area with a flat end of articulating member 510. It will be appreciated that other shapes for the inner surface of hole 504 and the adjacent surface of member 510 may also be suitable for providing substantial contact area.

Articulating member 510 with hemispherical end 512 can be formed by single point turning on a lathe or can be made as a single, as-cast investment casting. Retainer 506 is a spring clip with a circular or square cross-section and is disposed in circumferential grooves defined about hole 504 and articulating member 510. Articulating member 510 is rotatable within hole 504, allowing actuator arm 502 to articulate relative to the crimp ring segment. Hemispherical end 512 of articulating member 510 allows the member to engage the pivot port of the segment regardless of orientation and allows arm 502 to pivot within the port of the segment, as actuator arm 502 is pivoted during a crimp operation.

Figure 22C:
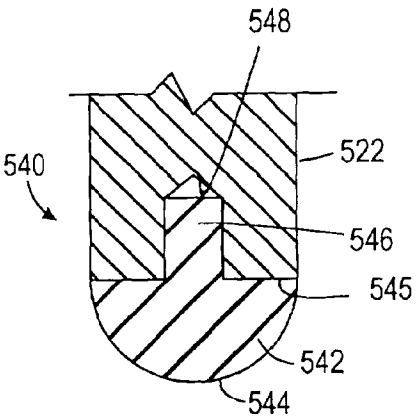
FIGS. 22A–E illustrate embodiments of hemispherical end assemblies for an actuator arm according to certain teachings of the present disclosure.
Figure 22E:
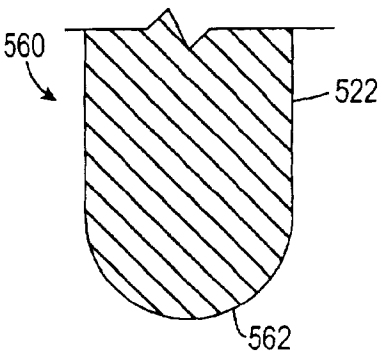
Figure 22B:
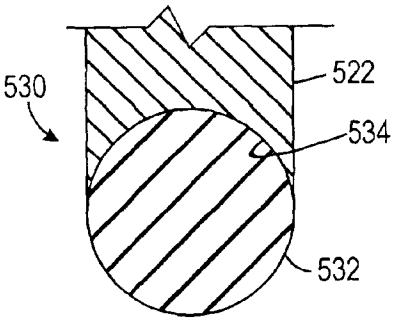
Figure 22D:
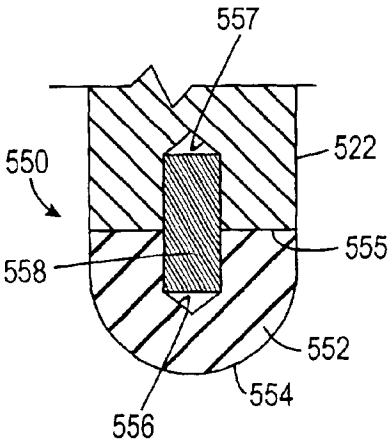
Figure 22A:
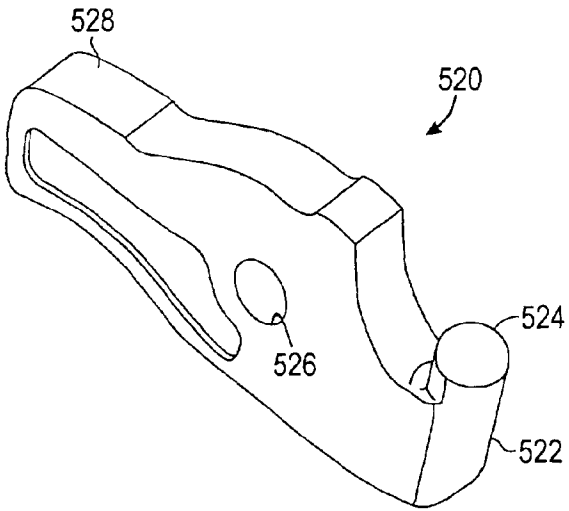

Referring to FIG. 22A, an embodiment of an actuator arm 520 according to certain teachings of the present disclosure is illustrated. Actuator arm 520 includes an end portion 522, a pivot bore 526, and a cam surface 528. End portion 522 has a hemispherical end 524 for articulating the arm in a pivot port (not shown) of a crimp ring segment. Embodiments of hemispherical end assemblies being fixedly attached to end portion 522 of actuator arm 520 will now be discussed with reference to FIGS. 22B–E.

Referring to FIG. 22B, a hemispherical end assembly 530 includes a spherical member or ball bearing 532 fixedly attached to end portion 522 of the actuator arm (not shown). A pocket 534 in end portion 522 is formed by machining the distal end of the end portion 522. Pocket 534 can be hemispherical, as shown, or can have a conical drill point. Spherical member 532 is disposed in pocket 534 and can be attached to end portion 522 by a number of methods known in the art. For example, spherical member 532 can be swaged, brazed, glued, welded, spun welded, or resistance welded in pocket 534. It is also possible to cast arm 522 around spherical member 532 by placing spherical member 532 in a mold, such as a sand-cast mold, and pouring molten metal into the mold to form arm 522

Referring to FIG. 22C, a hemispherical end assembly 540 includes a hemispherical member 542 fixedly attached to end portion 522 of the actuator arm. End portion 522 defines a face 545 and a hole 548, which are formed by machining the distal end of end portion 522. Hemispherical member 542 includes a hemispherical surface 544 and a shank 546. Hemispherical surface 544 is formed by turning and machining member 542. Shank 546 is disposed in hole 548. Hemispherical member 542 can be attached to end portion 522 by a number of methods known in the art. For example, shank 546 can be press fit into hole 548, threaded into hole 548, or held by a retainer or spring clip (not shown) disposed in hole 548. Alternatively, shank 546 can be disposed in hole 548 and a cross hole (not shown) can be drilled in end portion 522 and though shank 546 to receive a hinge pin (not shown). In addition, member 542 can be welded, brazed, glued, or magnetically held onto end portion 522.

Referring to FIG. 22D, a hemispherical end assembly 550 includes a hemispherical member 552 and a pin 558 on end portion 522 of the actuator arm. End portion 522 defines a face 555 and a hole 557, which are formed by machining the distal end of end portion 522. Hemispherical member 552 includes a hemispherical surface 554 and a hole 556. Hemispherical surface 554 is formed by turning and machining member 552 or by casting to shape via an investment casting process, for example. Hemispherical member 552 has a flat surface disposed adjacent face 555 on end portion 522. Pin 558 is disposed in holes 556 and 557. Pin 558 can be a threaded stud or can be a dowel pin having any cross-section. Hemispherical member 552, pin 558, and end portion 522 can be attached together by a number of methods known in the art. For example, hemispherical member 554, pin 558, and end portion 522 can be press fit together, threaded together, or held by spring clips disposed in holes 556 and 557. Alternatively, hemispherical member 554, pin 558, and end portion 522 can be welded, brazed, glued, or magnetically held together.

Referring to FIG. 22E, a hemispherical end assembly 560 includes a hemispherical surface 562 integrally formed on end portion 522 of the actuator arm. Hemispherical surface 562 can be cast as part of end portion 522. Alternatively, hemispherical surface 562 can be machined on the distal end of the cast end portion 522. The machining of surface 562 can be performed by interpolating the hemispherical shape, by using a form tool, by manipulating the actuator arm while grinding or machining surface 562 on end portion 522 with a flat surface, by tuning the arm in a lathe, or by using electrical discharge machining.

A number of techniques can be used to improve the surface finishes of cast spherical or hemispherical members in accordance with certain teachings of the present disclosure. In addition, the techniques can be used to improve the surface finishes of a cast female pocket on a crimp ring segment or on an actuator bushing as disclosed below with reference to FIG. 23. The cast parts can be machined with a form tool and then polished. Polishing techniques can include using a buffing wheel, abrasive slurry, or a vibratory hopper with a polishing media. Other polishing techniques can include electro-chemical polishing techniques or extrusion honing techniques. Other techniques to improve the surface finish of the cast part can include electrical discharge machining, sanding, multi-axis grinding, plunge grinding with a contoured stone, abrasive/shot blasting, hard chrome plating, spray welding, or machining using circle/spiral interpolation with a ball end mill.

J. Actuator Bushing Assembly

Figure 23:
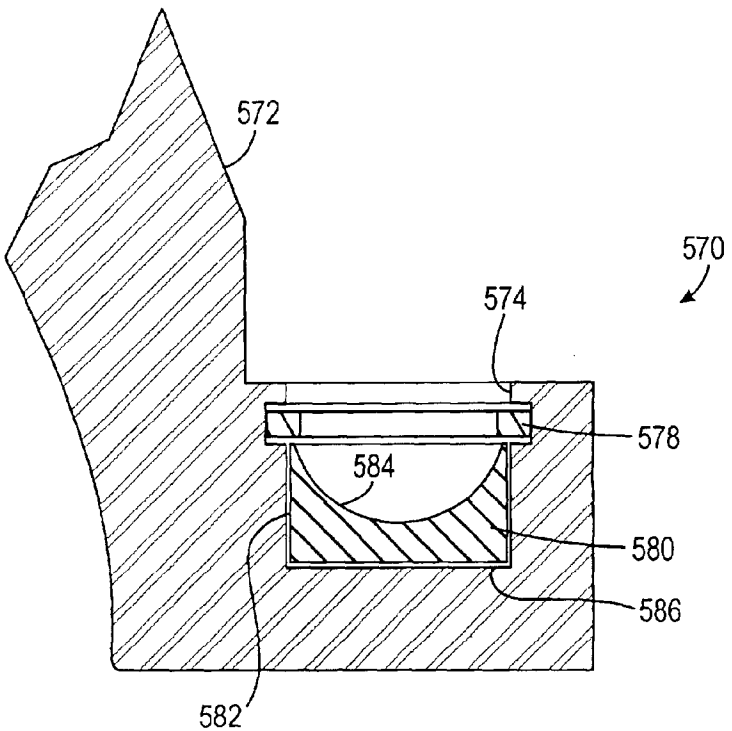
FIG. 23 illustrates an embodiment of an actuator bushing according to certain teachings of the present disclosure.

Referring to FIG. 23, a bushing assembly 570 for articulating a crimp ring segment 572 relative to an actuator arm (not shown) in accordance with certain teachings of the present disclosure is illustrated. FIG. 23 illustrates a cross-sectional view of bushing assembly 570 on crimp ring segment 572. Bushing assembly 570 includes a bore 574 defined in segment 572. An actuator bushing 580 is disposed in bore 574. Although only one bushing assembly 570 is illustrated for one segment 572, it is understood that another bushing assembly (not shown) may be similarly formed between a second arm and a second segment.

Actuator bushing 580 includes a substantially cylindrical sidewall 582, a female pocket 584 for an actuator arm, and a flat, rounded, or conical bottom surface 586. Female pocket 584 is hemispherical to mate with a corresponding male hemispherical end of the actuator arm. Actuator bushing 580 can be made using a lathe or a similar process to provide an improved surface finish on hemispherical female pocket 584. A number of techniques, such as those described above, can be used to improve the surface finish of hemispherical female pocket 584. A retaining ring 578 is disposed in bore 574 to hold actuator bushing 580 therein. In one embodiment, actuator bushing 580 is rotatably disposed in bore 574. Alternatively, actuator bushing 580 can be fixedly disposed in bore 574, in which case bushing 580 can be held by a weld, glue, an interference fit, or the like with sidewalls of bore 574 instead of with ring 578.

The foregoing description of preferred and other embodiments is not intended to limit or restrict the scope or applicability of the inventive concepts conceived of by the Applicants. In exchange for disclosing the inventive concepts contained herein, the Applicants desires all patent rights afforded by the appended claims. Therefore, it is intended that the invention include all modifications and alterations to the full extent that they come within the scope of the following claims or the equivalents thereof.

What is claimed is:

1. An assembly for articulating an actuator arm relative to a crimp ring segment, comprising:

a first portion coupling with the arm and defining a first axis of articulation;

a first pin defining the first axis of articulation and having one end hingedly attached to the arm;

the one end of the first pin defining a hole substantially transverse to the first axis of articulation and hingedly attached to the arm by a hinge pin through the arm and the transverse hole; and a second portion coupling between the first portion and the crimp ring segment and defining a second axis of articulation.

2. The assembly of claim 1, wherein the first and second articulating axes are substantially orthogonal.

3. The assembly of claim 1, wherein the transverse hole is elongated along the first axis of articulation defined by the first pin.

4. The assembly of claim 1, wherein the second portion of the assembly defines an at least partially cylindrical surface for engaging the segment.

5. An assembly for articulating an actuator arm relative to a crimp segment, comprising:

a first portion coupling with the arm and defining a first axis of articulation;

a first pin defining the first axis of articulation and having one end hingedly attached to the arm;

a second portion coupling between the first portion and the crimp ring segment and defining a second axis of articulation; and a cam member on the first pin positioned between the arm and the second potion of the assembly.

6. The assembly of claim 5, wherein the cam member is slideably positioned on the first pin or is integrally attached on the first pin.

7. The assembly of claim 6, further comprising a biasing member positioned between the arm and the cam member or positioned between the cam member and the second portion of the assembly.

8. The assembly of claim 5, wherein the cam member defines a curved surface for engaging the arm.

9. The assembly of claim 5, wherein the cam member defines a flat surface for engaging the second portion of the assembly.

10. An assembly for articulating an actuator arm relative to a crimp ring segment, comprising:

a first portion coupling with the arm and defining a first axis of articulation; and a second portion coupling between the first portion and the crimp ring segment and defining a second axis of articulation;

wherein the first portion comprises a cam member positioned between the arm and the second portion, the cam member defining a curved surface for engaging the arm and defining a flat surface for engaging the second portion of the assembly.

11. The assembly of claim 10, wherein the cam member comprises a first integral pin hingedly attached to the arm.

12. The assembly of claim 10, wherein the cam member comprises a second integral pin defining the first axis of articulation and rotatably coupled with the second portion.

13. An assembly for articulating an actuator arm relative to a crimp ring segment, comprising:

a first portion coupling with the arm and defining a first axis of articulation; and a second portion coupling between the first portion and the crimp ring segment and defining a second axis of articulation;

wherein the second portion comprises a second pin defining the second axis of articulation and rotatably coupled with the first portion of the assembly.

14. The assembly of claim 13, wherein the first portion has a distal end defining the first axis of articulation, and wherein the second pin defines a hole substantially transverse to the second axis of articulation and having the distal end of the first portion positioned in the transverse hole.

15. The assembly of claim 14, wherein the distal end of the first portion is fixedly or removably positioned in the transverse hole in the second pin.

16. An assembly for articulating an actuator arm relative to a crimp ring segment, comprising:

a first portion coupling with the arm and defining a first axis of articulation; and a second portion coupling between the first portion and the crimp ring segment and defining a second axis of articulation;

wherein the second portion of the assembly comprises a second pin attached to a bifurcate end of the segment.

17. The assembly of claim 16, wherein at least one end of the second pin comprises a tab for engaging a portion of the bifurcate end of the segment such that articulation of the second pin relative to the segment about the second axis is limited.

18. An apparatus for deforming a workpiece, comprising:

at least one segment for engaging the workpiece;

at least one arm for actuating the segment;

an assembly for articulating the arm relative to the segment, the assembly comprising:

a first pin defining a first axis of articulation and having a first end hingedly attached to the at least one arm, a second pin defining a second axis of articulation, wherein the first and second pins couple between the arm and the segment such that the arm articulates relative to segment about the first and second axes of articulation.

19. The apparatus of claim 18, wherein the first end of the first pin defines a hole substantially transverse to the first axis of articulation and hingedly attached to the at least one arm by a hinge pin in the transverse hole.

20. The apparatus of claim 19, wherein the transverse hole is elongated along an axial length of the first pin.

21. The apparatus of claim 18, wherein the segment defines a pocket and wherein the second pin removably positions in the pocket of the segment.

22. The apparatus of claim 18, wherein the segment defines a holder and wherein the second pin is attached, to the holder of the segment.

23. An apparatus for deforming a workpiece, comprising:

at least one segment for engaging the workpiece;

at least one arm for actuating the segment;

a cam member positioned between the at least one arm and the at least one segment; and an assembly for articulating the arm relative to the segment, the assembly comprising:

a first pin defining a first axis of articulation, a second pin defining a second axis of articulation, wherein the first and second pins couple between the arm and the segment such that the arm articulates relative to segment about the first and second axes of articulation;

wherein the cam member has a curved surface for engaging the at least one arm and having a flat surface for engaging the second pin.

24. The apparatus claim 23, wherein the cam member is integrally attached on the first pin or is slideably positioned on the first pin.

25. An apparatus for deforming a workpiece, comprising:

at least one segment for engaging the workpiece;

at least one arm for actuating the segment;

an assembly for articulating the arm relative to the segment, the assembly comprising:

a first pin defining a first axis of articulation, a second pin defining a second axis of articulation, wherein the first and second pins couple between the arm and the segment such that the arm articulates relative to segment about the first and second axes of articulation, and wherein the second pin defines a hole substantially transverse to the second axis of articulation, and wherein a distal end of the first pin is fixedly or removably positioned in the transverse hole of the second pin.

26. A crimping apparatus, comprising:

at least one segment for crimping;

at least one arm for actuating the at least one segment;

first means for articulating about a first axis of articulation;

first means for hingedly coupling the first articulating means to the arm;

second means for articulating about a second axis of articulation;

second means for coupling the second articulating means to the segment; and means for coupling the first and second articulating means together, including means for biasing the coupling between the arm and the segment.

27. The crimping apparatus of claim 26, wherein the second coupling comprises means for rotatably attaching the second articulating means to the segment.

28. The crimping apparatus of claim 26, wherein the means for coupling the first and second articulating means together comprising means for removably and rotatably coupling the first and second articulating means together.

29. The crimping apparatus of claim 26, further comprising third means for articulating about a third axis articulation.

30. The crimping apparatus of claim 26, further comprising means for substantially transferring pivoting motion of an end of the arm substantially perpendicular to a plane that is substantially parallel to the second axis of articulation.

* * * * *